US005667395A

United States Patent [19]

Okada et al.

[11] Patent Number: 5,667,395

[45] Date of Patent: Sep. 16, 1997

[54] COMMUNICATION CARD AND STRUCTURE OF JACK FOR USE IN THE SAME

[75] Inventors: Masanobu Okada; Katsuo Ito, both of Nagaokakyo, Japan

[73] Assignee: Murata Mfg. Co., Ltd., Kyoto, Japan

[21] Appl. No.: 520,405

[22] Filed: Aug. 29, 1995

[30] Foreign Application Priority Data

| | | | |
|---|---|---|---|
| Aug. 29, 1994 | [JP] | Japan | 6-227357 |
| Feb. 20, 1995 | [JP] | Japan | 7-055166 |
| Feb. 20, 1995 | [JP] | Japan | 7-055167 |

[51] Int. Cl.[6] ..... H01R 13/44

[52] U.S. Cl. ..... 439/131; 439/946

[58] Field of Search ..... 439/131, 676, 439/964, 83, 344, 372, 329

[56] References Cited

U.S. PATENT DOCUMENTS

| | | |
|---|---|---|
| 5,183,404 | 2/1993 | Aldous et al. . |
| 5,336,099 | 8/1994 | Aldous et al. . |
| 5,338,210 | 8/1994 | Beckham et al. . |

FOREIGN PATENT DOCUMENTS

| | | |
|---|---|---|
| 558543 | 10/1993 | Japan . |
| 5271293 | 10/1993 | Japan . |
| 725654 | 5/1995 | Japan . |

*Primary Examiner*—David L. Pirlot
*Assistant Examiner*—Daniel Wittels
*Attorney, Agent, or Firm*—Loeb & Loeb LLP

[57] ABSTRACT

A communication card and the structure of a jack therefor. The end face of the card is provided with a slit-like aperture. Into the aperture there is inserted a base plate having a thickness smaller than the width of the aperture so as to allow insertion into the interior of the card and removal from the card. The base plate is provided with a notch directed to the outside when viewed from the card. The notch passes through the base plate in the direction of its thickness. The jack is formed by utilizing this notch. The plug, on the other hand, is of a rectangular parellelpiped shape and is electrically coupled to a cord. The inner surface of the notch is configured so as to be able to receive the plug. When the plug is inserted, the notch receives and holds the plug. At that time, the notch receives and holds the plug in such a manner that the direction of the longest edge among the edges of the plug, or the extending direction of the cord is parallel to the major planes of the card.

21 Claims, 36 Drawing Sheets

COMMUNICATION CARD AND STRUCTURE OF JACK FOR USE IN THE SAME

BACKGROUND OF THE INVENTION a) Field of the Invention

The present invention relates generally to a communication card intervening in connections between stations and communication channels, and more particularly to the structure of a jack for use with the communication card.

b) Description of the Related Art b1) Premise

To carry out communications between two or more computers (e.g., personal computers) or word processors, physical and logical connections must be established between these units by means of wire or radio communication channels, for instance, telephone lines (hereinafter, the physical connection will be referred to as "coupling", whereas circuitry and logical connection indicating a communicable state will be referred to as "connection"). In order to connect the apparatus intending to perform a communication (hereinafter, referred to simply as "station") with the communication channel, a communication controller must be provided which controls the action of transmitting signals from the station to the communication channel and the action of the station receiving signals from the communication channel. Various types of configurations are known as the communication controllers used for this end. The most compact one among them is an IC card incorporating a communication control circuit. Such a type of IC card is called a communication card.

The communication card converts a signal which the station intends to send out to a communication channel (hereinafter referred to simply as "transmission signal", into a format suitable for the communication channel, and converts a signal destined for the station which is supplied through the communication channel (hereinafter, referred to simply as "received signal") into a format suitable for the same station. In the case, for example, where the station is a digital unit and the communication channel is an analogue line, the communication card executes a digital to analogue conversion of the transmission signal and an analogue to digital conversion of the received signal, as well as signal amplification and other processing. Also, in the case, for example, where the station is a personal computer or other unit and the communication channel is a telephone line, the communication card will execute, in addition to the above, processing such as modulation, coding and compression of the transmission signal as well as demodulation, decoding and decompression of the received signal. Among the communication cards a modem card is a card incorporating a modulation/demodulation circuit and hence having modulation and demodulation functions.

As described above, the communication card intervenes between the station and the communication circuit. Accordingly, the communication card must be provided with a member for coupling with the station, and a member for coupling with the communication channel. In the same manner, the station must be provided with a member for coupling with the communication card, and the communication channel must be provided with a member for coupling with the communication card. In the case of, in particular, connecting three parties by wires, that is, the station, the communication card and the communication channel, it is preferable to utilize slot and module type connectors to couple them.

With these type of connections, the slot has a structure in which a member is arranged on the far side of an elongated aperture provided in the casing of the station for electrically coupling with the communication card. On one edge of the communication card, on the other hand, an electric coupling member is arranged corresponding thereto. These electric coupling members are provided in such a manner that when the communication card is sufficiently deeply inserted into the aperture of the slot with that same edge ahead, those electric coupling members are electrically coupled with each other. In this manner, the structure utilizing the slot would realize a electric coupling between the station and the communication card. It is to be appreciated that the slot has a function of receiving and retaining the communication card.

b2) General Constitution of Modular Connector

The modular connector is widely utilized in the case of using telephone lines as the communication channels. The modular connector includes a modular plug and a modular jack corresponding thereto. The modular plug is provided on the communication channel side, and the modular jack is provided on the communication card side. As shown in FIG. 46, by way of example, a modular plug 2 is provided on one end of the cord 21 constituting the communication channel, while a modular jack 3 is provided on one edge 11 having a larger thickness among four edges of the communication card 1. In the following description, that one edge is referred to as integrated connector. Moreover, the communication card 1 (and the slot) is dimensioned in such a manner that the modular jack 3 extends to the exterior from the aperture of the slot with the communication card 1 deeply inserted into the aperture of the slot.

With such a design, the coupling between the modular jack 3 and the modular plug 2 would result in an electrical coupling between the communication channel and the communication card 1. Also, since the communication card 1 is electrically coupled to the station by sufficiently deeply inserting the communication card 1 into the aperture of the slot, the communication channel and the station can be coupled with each other by means of the communication card 1. Under these conditions, when the station calls another station, or when the station receives a call from another station through a communication channel, a connection is established between the station and the communication channel by means of the communication card 1. This will ensure the realization of personal computer communications and the like.

The communication card 1 as shown in FIG. 46 is called a PC card, which is a modem card prescribed by PCMCIA (Personal Computer Memory Card International Association). The PC card ordinarily has a thickness of 5 mm. Due to the necessity of providing the modular jack 3, the thickness of an integrated connector 11 is set at 14 mm greater than the thickness of the other portions. Designated in the diagram by a chain line 4 is a card inserted into the other slot, for example, a memory card. The use of the PC card 1 with the memory card 4 would diversify the communications using PC card 1. For example, it is possible to store into the memory card 4 programs such as data compression and decompression, error detection and correction associated with various communication protocol, or to utilize the memory card 4 to expand the memory capacity of the PC card for the transmission and received signals.

FIGS. 47 to 53 illustrate a general constitution of the modular plug 2 and the modular jack 3. As their basic functions, the modular plug 2 and the modular jack 3 have an electric coupling function, an inserting direction regulation function, an insertion stopping function, and a returning prevention function.

The electric coupling function is implemented by contact pins 23 provided on the tip of a contact pin block 22, and contact wires 31 arranged within the interior of the modular jack 3. The contact pins 23 and the contact wires 31 are both made of electrically conducting materials. Within the interior of the contact pin block 22, the contact pins 23 are electrically coupled to a plurality of (e.g. four) lead wires extending in alignment from the cord 21. As shown in FIG. 50, the contact pins 23 are received in (four in the diagram) grooves 25 excluding the leftmost and rightmost grooves among a predetermined number of (six in the diagram) grooves 25 provided on the tip of the contact pin block 22. As shown in FIGS. 47 and 48, the surface of the contact pin block 22 is provided with a narrow free end 26 presenting a resilience at the base of its neck.

The contact wirings 31 are arranged diagonally and parallel to one another as shown in FIG. 52 within the interior of a socket 32 constituting the modular jack 3. A predetermined number of (six in the diagram) grooves 33 are provided on side walls designated by reference numeral 34 among the side walls of the socket 32, the contact wirings 31 being accommodated in a plurality of (four in the diagram) grooves 33 excluding the rightmost and leftmost grooves among the grooves as shown in FIG. 51. The contact wirings 31 pass through the side walls 34 and extend downward in FIGS. 51 to 53, the extended portion being used for the electric coupling with the circuit within the PC card 1.

When inserting the modular plug 2 into the modular jack 3, the modular plug 2 is inserted into the interior of the modular jack 3 along the direction B of FIG. 52 while depressing the narrow free end 26 in the direction J of FIG. 47. Then, as shown in FIG. 53, the contact pins 23 are brought into contact with the contact wirings 31. This will result in the electrical coupling between the modular plug 2 and the modular jack 3. In other words, the circuit within the PC card 1 is electrically coupled with the communication channel.

The inserting direction regulation function is implemented by the contact pin block 22 and the socket 32. Upon the insertion of modular plug 2 into the interior of the modular jack 3, the contact pin block 22 of the modular plug 2 is guided by the side walls of the socket 32. At that time, the contact pin block 22 and the socket 32 are both dimensioned so that the socket 32 can receive the contact pin block 22 and so that the contact block 22 can not be inserted from other directions or in other orientations. The surface of the contact pin block 22 is provided with the narrow free end 26, and hence the contact pin block 22 is rotationally asymmetrical. Thus, the inserting direction in which the modular plug 2 is inserted into the interior of the modular jack 3 will be regulated in the direction shown in FIG. 52. This allows the user to insert the modular plug 2 into the modular jack 3 constantly in the correct direction.

The insertion stopping function is implemented by a broad fixed end 27 provided at the tip of the modular plug 2 and having a broader width than that of the narrow free end, and a ledge 35 provided on the bottom of the modular jack 3. That is, when inserting the modular plug 2 into the modular jack 3, the broad fixed end 27 comes into contact with the ledge 35, preventing the modular plug 2 from further advancing.

The returning prevention function is implemented by a transition notch 28 extending from the narrow free end 26 sideward, and a retention ridge 36 provided on the side wall of the socket 32 as shown in FIG. 52. More specifically, the user inserts the modular plug 2 into the modular jack 3 along the direction B of FIG. 52 while depressing the narrow free end 26 (using, e.g., fingers) as shown in FIG. 48, and releases the fingers from the narrow free end 26, whereupon the retention ridge 36 comes into engagement with the transition notch 28. Accordingly, even though a force opposite to the direction B of FIG. 52 is applied to the modular plug 2, as long as the force is not too large, the modular plug 2 is not permitted to fall out of the modular jack 3 or to positionally shift to a large extent within the modular jack. When removing the modular plug 2 from the modular jack 3, the modular plug 2 is drawn out in the opposite direction to the direction B of FIG. 52 while depressing the narrow free end 26 as shown in FIG. 48.

In order to couple the PC card 1 with the communication channel by making use of the modular plug 2 and the modular jack 3 having such a structure, it is common practice that, as shown in FIG. 46 the PC card 1 is provided with the integrated connector 11, which is in turn equipped with the modular jack 3. However, such an arrangement of the jack entails some problems. Firstly, the integrated connector 11 protrudes from the slot in the state where the PC card 1 is loaded into the slot, and hence the presence of the integrated connector 11 would obstruct the insertion of, e.g., the memory card 4 into the adjacent slots. Secondly, when moving the station with the modular plug 2 removed from the modular jack 3, the integrated connector 11 will readily collide with external objects (e.g., a desk). Since the integrated connector 11 is thicker than the other portions and hence has a larger mass, the collision of the integrated connector 11 with external objects is apt to cause damage to the PC card 1. Thirdly, the necessity to increase the thickness of the integrated connector 11 compared with the other portions would result in increased production and sales costs, as well as increased complexity of the production processes, increase in material cost, and increase in the space for storing the products.

b3) Improvement in Structure of Modular Connector

To overcome these deficiencies, some improvements are proposed for the structure of the modular jack. One such improvement is a modular jack 3A shown in FIGS. 54 to 57. Although its configuration differs in some aspects, reference must be made to U.S. Pat. No. 5,183,404.

In FIG. 54, a retractable access portion 37 is provided which is capable of being accommodated within the PC card 1. The modular jack 3A is arranged on the retractable access portion 37 so that the modular plug 2 can be inserted from the direction D substantially orthogonal to major planes of the PC card 1. The major planes referred to here generally comprise two planes occupying the major part of the surface area of the PC card 1. The retractable access portion 37 is inserted into a jack slit 13 formed in one side of the PC card 1 so as to be slidable along the direction C parallel to the major planes. A limiting notch 39 is provided on the surface so as to be able to engage with a lever 12 arranged within the interior of the jack slit 13. It is natural that the positions of the lever 12 and the limiting notch 39 may be reversed. Due to the engagement of the lever 12 with the limiting notch 39, the retractable access portion 37 is positionally fixed at the time of using the modular jack 3A. Within the internal space of the jack slit 13, that is, a jack chamber 14, there may be arranged a spring or the like for saving the labor of protraction and retraction of the retractable access portion 37.

The modular jack 3A further includes a straight aperture 310 formed in the retractable access portion 37 along the direction D. It is to be noted that U.S. Pat. No. 5,183,404 employs an angled aperture in place of the straight aperture. The contact wirings 31 are arranged within the interior of the straight aperture 310. The shape and dimension of the straight aperture 310 are determined so as to be able to apply an inserting direction regulation function, insertion stopping function and returning prevention function. The straight aperture 310 is provided in such a manner as to be exposed to the exterior of the PC card 1 in the state where the lever 12 is engaged with the limiting notch 39, in other words, so as to be able to receive the modular plug 2. Although in FIG. 55 the straight aperture 310 passes through the retractable access portion 37, a blind aperture may be employed as long as the retractable access portion 37 has a sufficient thickness. It is to be appreciated that depending on the position of the retention ridge 36 within the straight aperture 310, the tip of the modular plug 2 may protrude to the back of the retractable access portion 37 as shown in FIG. 56, or it may not protrude thereto as shown in FIG. 57.

According to the improved modular jack 3A, some of the problems entailed in the general structure shown in FIG. 46 can be solved. Firstly, the improved modular jack 3A does not include the integrated connector 11 which may otherwise obstruct the insertion of the memory card 4 into the adjacent slot. Accordingly, in the situation where the retractable access portion 37 is accommodated in the jack chamber 14, the memory card 4 can be inserted into the adjacent slot more easily than the general structure. Secondly, when moving the station with the modular plug 2 removed from the modular jack 3A, a mere accommodation of the retractable access portion 37 into the jack chamber 14 would prevent the PC card from impinging on the desk or the like. Thus, it is difficult for damage to the PC card 1 to occur. Thirdly, because there is no necessity to provide the integrated connector 11, the production and sales costs can be reduced, due to the simplified manufacturing processes, as well as material cost, and space for storing the products.

Nevertheless, the improved modular jack 3A has some problems. Firstly, the modular plug must be inserted into the straight aperture 310 along the direction substantially orthogonal to the major planes, which is a troublesome task. Secondly, in case of the use in an upside-down posture relative to FIGS. 56 and 57, the modular plug 2 and the cord 21 may conflict with other objects (e.g., a desk or other cards). That is, if it is applied to the PC card 1, another object conflicting therewith, or a casing of the station, stable actions of the PC card 1, another card, or the station could not be secured. Thirdly, since the modular plug 2 and the cord 21 protrude in the direction substantially orthogonal to the major planes, the modular plug must be removed prior to the insertion of, e.g., the memory card 4 into the adjacent slot, depending on the setting of the inserting direction of the modular plug 2. Fourthly since the cord 21 extends from the modular plug 2 in the direction substantially orthogonal to the major planes, the cord 21 may possibly become entangled with other cords, or conflict with other cards. Fifthly, the contact wirings 31 must be long enough to ensure a sufficient contact length between the contact wirings 31 and the contact pins 23, and hence the retractable access portion 37 must be thick enough, thus resulting in the reduction of the degree of freedom in designing the retractable access portion 37.

SUMMARY OF THE INVENTION

It is therefore the first object of the present invention to implement a communication card which allows another card to be easily inserted into the adjacent slot, and which is difficult to damage when moving the station with the plug removed from the jack, and which has low production and sales costs. This object is accomplished by the abolition of the integrated connector.

The second object of the present invention is to improve the workability in inserting the plug into the jack. This object is accomplished by a) combination of the abolition of the integrated connector and the change in the plug retaining orientation; b) combination of the abolition of the integrated connector, improvement of the jack biasing means, and the improvement of the means for retaining the jack to the communication card; or c) combination of the foregoing three items and the improvement of the means for retaining the plug.

The third object of the present invention is to implement a communication card preventing the plug and attendant member, e.g., a cord from conflicting with other members, e.g., cords or other communication cards, and more securely ensuring stable arrangement of the stations and stable actions of the cards, and having a higher usability and reliability. This object is accomplished by a) combination of the abolition of the integrated connector and a change in the plug retaining posture; and b) combination of the above two items and the improvement of the plug retaining means.

The fourth object of the present invention is to eliminate the necessity of removing the plug when inserting other cards into the adjacent slots and hence to relieve the burden imposed on the user. This object is accomplished by the combination of abolition of the integrated connector and a change in plug retaining orientaion.

The fifth object of the present invention is to simplify the operation of removing the plug from the jack and accordingly to realize a jack having a high usability. This object is accomplished by the combination of the abolition of the integrated connector and the improvement of the jack biasing means.

The sixth object of the present invention is to make it possible to automatically accommodate the jack after the removal of the plug, and therefore to realize a jack with a reduced possibility of being damaged and allowing less stress to be exerted on the station and having a higher usability, and hence to elongate the life of the stations and the communication cards, this object being accomplished by the combination of the abolition of the integrated connector and an improvement to the jack biasing means.

The seventh object of the present invention is to render the configuration of the jack compact when the plug is removed and simultaneously to minimize the possibility of damage, this object being accomplished by the combination of the abolition of the integrated connector, a change in the plug retaining orientation and an improvement in the plug retaining means.

The eighth object of the present invention is to realize a jack having a higher freedom in dimensional design, this object being achieved by the combination of the abolition of the integrated connector and a change in the plug retaining orientation.

The ninth object of the present invention is to simplify the structure of the jack, leading to reduced cost, this object being accomplished by a) combination of the abolition of the integrated connector and an improvement to the jack biasing means; b) the combination of the abolition of the integrated connector, a change in plug retaining orientation and an improvement to the plug retaining means; or c) the combination of the above and an improvement of the electric coupling means.

The tenth object of the present invention is to securely deal with failure and hence to realize the jack having a higher reliability, this object being accomplished by the combination of the abolition of the integrated connector and an improvement to the jack biasing means.

The eleventh object of the present invention to enhance the external appearance of the communication card, this object being accomplished by an improvement to the means for accommodating the jack into the communication card.

The first aspect of the present invention is a card, and the second aspect of the present invention is a jack for use in the card. The card has two major planes and an end face providing a thickness of the card. The upper limit of the thickness of the card is provided and a slot-like aperture is formed in the end face. The card has a base plate which includes a top surface and a bottom surface both parallel to the major planes of the card, and the end face providing the thickness. The thickness of the base plate is smaller than the width of the aperture. The base plate is inserted into the aperture so as to allow accommodation into the interior of the card and removal from the card. The base plate has a notch which is provided in such a manner as to be directed to the exterior when viewed from the card, the notch passing through the base plate in its thickness direction. The notch is provided with an inner surface having a shape capable of receiving a substantially rectangular parallelpiped plug to which a cord is electrically coupled. The jack is formed by utilizing the notch and when the plug is inserted, receives and retains the plug.

Due to the abolition of the integrated connector in this manner, there is no need to make the thickness of a part of the card larger than the thickness of the other portions. This results in easy insertion of the other cards into the adjacent slots, realizing a communication card which is difficult to damage when moving the station with the plug removed from the jack and whose production and sales costs are low. Furthermore, appropriate setting of the direction in which the card is accommodated into the jack will enhance the external appearance of the card.

In the present invention, while regulating the plug inserting direction by at least a part of the inner surface of the notch, the jack receives and retains the plug in such a manner that the direction of the longest edge of the plug edges or the extending direction of that cord becomes parallel to the major planes of the card. This means that the plug retaining orientation in the present invention differs from that of the prior art.

Thus, in the present invention, the combination of these two types of improvements would enable the user to readily insert the plug, in other words, it would improve the workability at the time of inserting the plug into the jack. Also, this will prevent the plug and the attendant member from conflicting with other members irrespective of the orientation of the card when using the card. This results in a secure guarantee of stable arrangement of the stations and stable actions of the cards, realizing the communication card having a higher usability and reliability. Also, no necessity to remove the plug when inserting other cards into the adjacent slots would relieve the burden imposed on the user. In addition, the freedom of dimensional design will be enhanced.

In the case of a plug, e.g., a modular plug having a claw-like member to be operated upon the insertion into the jack and upon the removal from the jack, the plug retaining orientation in the present invention is either such that the operating direction of the claw-like member is substantially parallel to the major planes of the card or such that it is substantially orthogonal thereto.

In the case of the former in particular, a part of the inner surface of the notch can be utilized to form a falling out prevention member. The falling out prevention member serves to prevent the plug falling out at least during the time from inserting the plug in place until removing the plug by the operation of the claw-like member.

In the latter case, the holder rotatably mounted on the inner surface of the notch would prevent the plug from being inserted beyond a predetermined position, and prevent the falling off of the plug at least during the time after inserting the plug in place until removing the plug by the operation of the claw-like member.

Alternatively, in the latter case, a retainer member capable of retaining the claw-like member is provided on the base plate, and a stirrup member for regulating the plug inserting and removing directions is provided on the inner surface of the notch. At that time, it is preferable to design the stirrup member so that the plug can be inserted into the jack along the direction parallel to the major planes and with the claw-like member directed to the notch side, making it possible to lock the base plate by the claw-like member, thus facilitating the regulation of the inserting and removing direction. Also, to improve the operability, a biasing member is provided for biasing the stirrup member toward the base plate. Furthermore, the biasing member is utilized to electrically couple the jack with the plug, thereby simplifying the configuration of the apparatus.

Upon the insertion of the plug into the jack and upon the removal of the plug from the jack, it is preferable to guide the plug so that the inserting direction and the removing direction coincide with the respective predetermined directions. The direction regulating member provided therefor may be implemented by the inner surface itself of the notch or may be implemented by mounting a separate member on the inner surface. In the same manner, the insertion stopping member and the falling out prevention member may also be implemented by the inner surface itself of the notch or by the attachment of a separate member to the inner surface, the insertion stopping member being intended to stop further insertion at the time when the plug reaches a predetermined position upon the insertion of the plug into the jack, the falling out prevention member being intended to prevent the plug falling out during the time from inserting the plug in place within the jack and until the plug is removed from the jack. The electric coupling member may be directly or indirectly mounted on the inner surface of the notch, the electric coupling member serving to electrically couple with the cord by way of the plug until the plug is removed from the jack after inserting the plug in place within the jack. Preferably, as many as possible (at least two) of these four types of members are provided by the inner surface, with the remainder being provided by a separate member attached to the inner surface.

The insertion stopping member and the falling out prevention member can be implemented by a common member. For instance, a holder may be rotatably mounted on the inner surface of the notch so that the holder can stop the insertion and removal until the plug is removed from the jack after the insertion of the plug into a predetermined position. By virtue of such a configuration, there is obtained a jack and card having a higher integration and a simple structure. That is, the configuration of the jack with the plug removed is made compact while minimizing the possibility of damage to the jack.

Also, the direction regulation member and electric coupling member can be implemented by a common member. For instance, the stirrup member is rotatably mounted on the base plate, the stirrup member serving to guide the plug in such a manner that the inserting direction and the removing direction coincide with their respective predetermined directions when the plug is inserted into the jack and when the plug is removed from the jack. Simultaneously, an electrically conducting member is provided on the stirrup member, the electrically conducting member being electrically coupled with the cord by way of the plug, at least until the plug is removed from the jack after the insertion of the plug in place within the jack. This structure will result in the jack and card having a higher integration and a simple structure. At the same time, it is capable of preventing the plug from protruding to the surface opposite to the rotational direction of the stirrup member, thereby securely preventing the plug and attendant members from conflicting with other members, to thus securely guarantee a stable arrangement of the station and a stable action of the cards and obtain a communication card having a higher usability and reliability.

Furthermore, the provision of the member for biasing the base plate will allow the base plate to be automatically squeezed toward the exterior of the card. In order to automatically squeeze the base plate toward the exterior of the card, the base plate must be urged to the outside when viewed from the card. Also, to prevent the base plate from protruding outside the card when the jack is not being used, the base plate must be positionally fixed while being accommodated within the card.

On the contrary, the base plate can be automatically pulled into the interior of the card. To automatically pull the base plate into the interior of the card, the base plate must be urged inward when viewed from the card. A helical tension spring is an example of a member realizing such biasing. One of two ends of the helical tension spring may be fixed to the interior of the card, the other being fixed to the base plate. In order that the base plate is not led into the interior of the card in use of the jack, it is preferable to fix the position of the base plate with it drawn out from the card. However, there is no need to continue to constantly employ such a fixing method during the use of the jack. For instance, the insertion of the plug into the jack is detected, and response to the detection of the fixing may be released. This ensures that the jack continues to be positioned outside the card by the engagement of any one of the faces of the plug with the aperture until the plug is drawn out after the release of the fixing. Once the plug has been drawn out, that engagement is released to automatically accommodate the jack into the interior of the card. It is natural that the fixing may be released in accordance with the operation of the user.

Such a constitution will simplify the operation of removing the plug from a jack and hence realize the jack having a higher usability. Also, the presence of the base plate within the card when the jack is not beging used will result in a jack minimizing the possibility of damage and exerting less stress onto the station and having a higher usability. This leads to an extension of the life of the stations and the communication card. Moreover, irrespective of the failure of the lock member or the like, the base plate is accommodated within the card when the jack is not being used, thereby realizing a secure and automatic dealing with such failure and hence realizing a jack having a higher reliability. Also, since the plug surfaces are utilized for the engagement, a higher workability is ensured when inserting the plug into the jack. Thus, the required structure is simple and hence is low in price.

Furthermore, a squeezing member may be provided which squeezes the base plate toward the outside of the card so that the jack is exposed to the exterior of the card. This squeezing force can be implemented by making use of an external pressing force, e.g., a pressing force caused by the insertion of the card into the slot. In order to generate the pressing force with the insertion of the card into the slot, the squeezing member is provided in such a manner that a pressing force from the key is exerted when the key provided within the slot is engaged with the guide slot serving as a guide upon the insertion of the card into the slot of the station. Alternatively, the squeezing member is provided in such a manner that a pressing force is exerted from the pin provided in the station for electrically coupling the card and the station. The user can take out the base plate (or a part thereof) thus squeezed and fix the position of the base plate in a such state. This will contribute to the improvement of the workability upon the insertion of the plug into the jack. Also, since when the jack is not being used the base plate constantly remains within the card, there is obtained a jack having a reduced possibility of being damaged and exerting less stress onto the station and having a higher usability.

BRIEF DESCRIPTION OF THE DRAWINGS

FIG. 1 being a partial top plan view showing in phantom the interior of a PC card; FIG. 2 being a perspective view showing the direction in which a modular plug is inserted; and FIG. 3 being a perspective view showing the state in which the modular plug is inserted;

FIG. 4 being a partial top plan view for explaining the structure; FIG. 5 being a partial top plan view showing the state in which the modular jack is accommodated in the PC card; FIG. 6 being a partial top plan view showing the state in which the modular jack is drawn out of the PC card; FIG. 7 being a partial top plan view showing the state immediately after the insertion of a modular plug; and FIG. 8 being a partial top plan view showing the state after the insertion of the modular plug;

FIG. 9 being a partial top plan view showing another example of an engagement structure; FIG. 10 being a partial top plan view showing another example of the inserting direction; and FIG. 11 being a partial top plan view showing still another example of the inserting direction;

FIG. 12 being a sectional view of the PC card taken along a section parallel to the major planes; FIG. 13 being an end view showing the state in which guide tracks and pin sockets are arranged; FIG. 14 being a sectional view of the PC card and a slot taken along a section parallel to the major planes, showing the state in which the PC card is ready to be inserted into the slot; FIG. 15 being a sectional view of the PC card and the slot taken along a section parallel to the major planes, showing the state in which the PC card has just been inserted into the slot; and FIG. 16 being a sectional view of the PC card and the slot taken along a section parallel to the major planes, showing the state in which the position of the retractable access portion is fixed;

FIG. 17 being a sectional view of the PC card and the slot taken along a section parallel to the major planes, showing the state in which the PC card is ready to be inserted into the slot; and FIG. 18 being a sectional view of the PC card and the slot taken along a section parallel to the major planes, showing the state in which the PC card has just been inserted into the slot;

FIG. 19 being a partially cut-away perspective view viewed from diagonally above; FIG. 20 being a front elevational view showing the state in which the modular plug is being inserted into the slot, particularly depicting the vicinity of the retractable access portion; and FIG. 21 being a front elevational view showing the state in which the modular plug has just been inserted into the slot, particularly depicting the vicinity of the retractable access portion;

FIG. 22 being a partially cut-away perspective view viewed from diagonally above; FIG. 23 being a partially enlarged sectional view depicting an example of the wiring around a support stirrup; FIG. 24 being a side elevational view showing the state in which the retractable access portion is accommodated in the PC card; FIG. 25 being a side elevational view showing the state in which the retractable access portion is drawn out of the PC card; FIG. 26 being a side elevational view showing the state in which the modular plugis inserted into the slot; and FIG. 27 being a side sectional view of the modular jack in the state shown in FIG. 26;

FIG. 28 being a partially enlarged sectional view depicting another example of the wirings around the support stirrup; FIG. 29 being a partially enlarged sectional view depicting another example of contact wirings; FIG. 30 being a partially enlarged sectional view depicting still another example of the wirings around the support stirrup; FIG. 31 being a partially enlarged sectional view showing still yet another example of the wirings around the support stirrup; FIG. 32 being a partially enlarged sectional view showing another example of the support stirrup; and FIG. 33 being a partially enlarged perspective view showing still another example of the support stirrup;

FIG. 36 being a top plan view showing the state in which the retractable access portion is drawn out, depicting in phantom the interior of the PC card; FIG. 37 being a side elevational view showing the state in which the retractable access portion has been drawn out; FIG. 38 being a front elevational view showing the state in which the retractable access portion has been drawn out; FIG. 39 being a bottom plan view showing the state in which the retractable access portion has been drawn out, depicting in phantom the interior of the PC card; FIG. 40 being a side elevational view showing the state in which the retractable access portion has been accommodated in the PC card; FIG. 41 being a side elevational view showing the state in which the retractable access portion has been drawn out of the PC card; FIG. 42 being a side elevational view showing the state in which the modular plug has been inserted; and FIG. 43 being a side sectional view of the modular jack in the state shown in FIG. 42;

FIG. 44 being a top plan view showing the state in which the retractable access portion has been drawn out; and FIG. 45 being a bottom plan view showing the state in which the retractable access portion has been drawn out;

FIG. 46 being a perspective view showing the state in which the modular jack is arranged; FIG. 53 being a side sectional view showing the state in which the modular plug has been inserted into the modular jack, depicting a section not including the contact wiring receiving groove and parallel to the A—A section;

FIG. 54 being a sectional view taken along a section parallel to the major planes of the PC card; FIG. 55 being a cut-away perspective view; FIG. 56 being a partial sectional view showing an example of the state in which the modular plug has been inserted into the modular jack; and FIG. 57 being a partial side elevational view showing another example of the state in which the modular plug has been inserted into the modular jack.

DETAILED DESCRIPTION OF THE PREFERRED EMBODIMENTS

Figure 1:
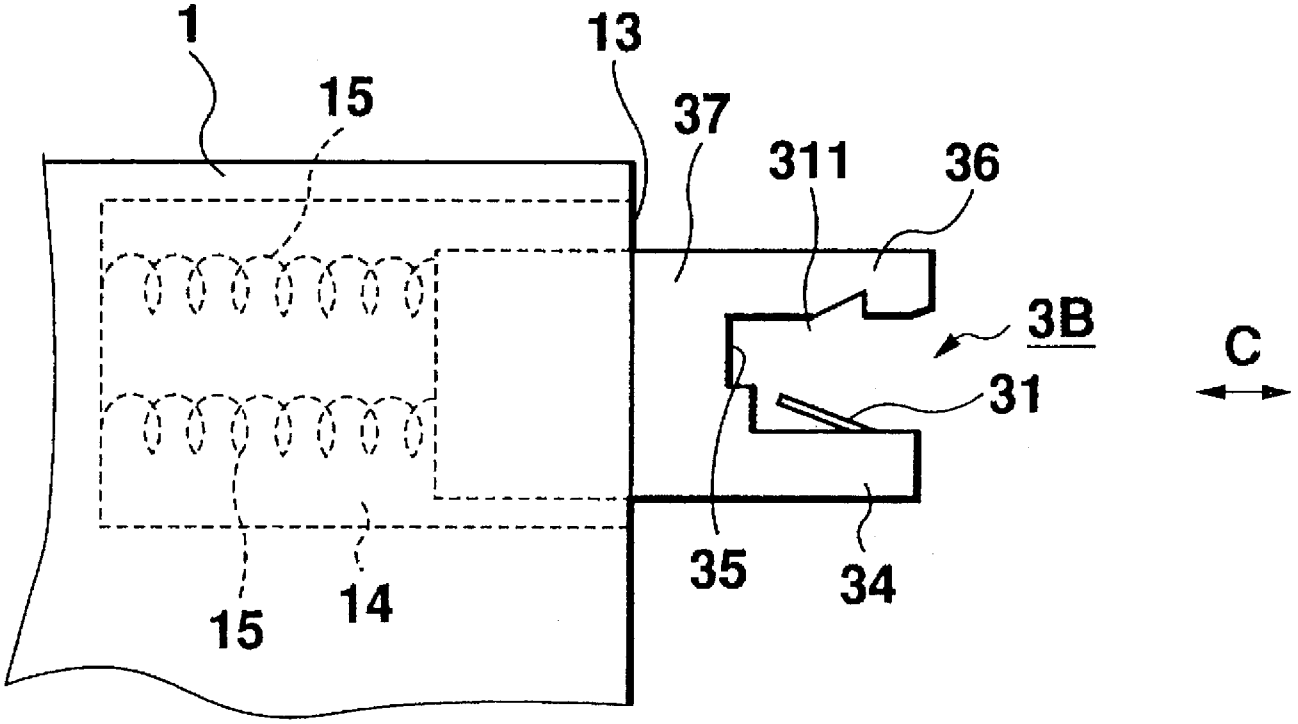
FIGS. 1 to 3 illustrate a modular jack according to a configuration previously filed by the present applicant.

Exemplarily preferred embodiments of the present invention will now be described with reference to the accompanying drawings. It is to be noted that common structures in the embodiments are designated by the same reference numerals, the description of which will be omitted.

The same reference numerals will also be given to constituent elements identical or corresponding to those in the foregoing prior art examples or a configuration already filed, and the description of these elements will be omitted.

a) Invention Already Filed

Figure 3:
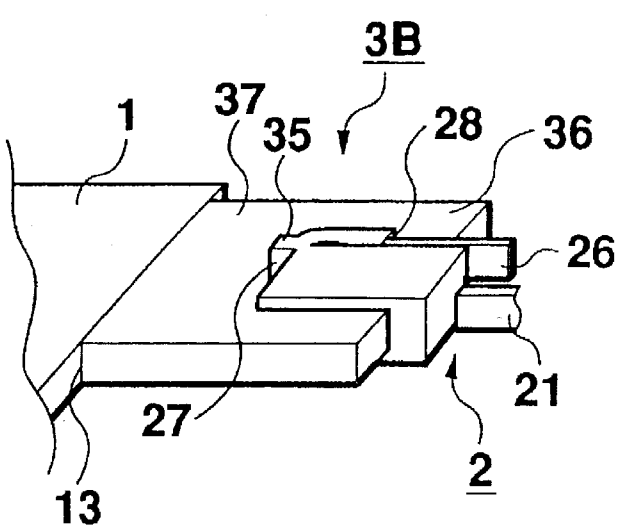
Figure 2:
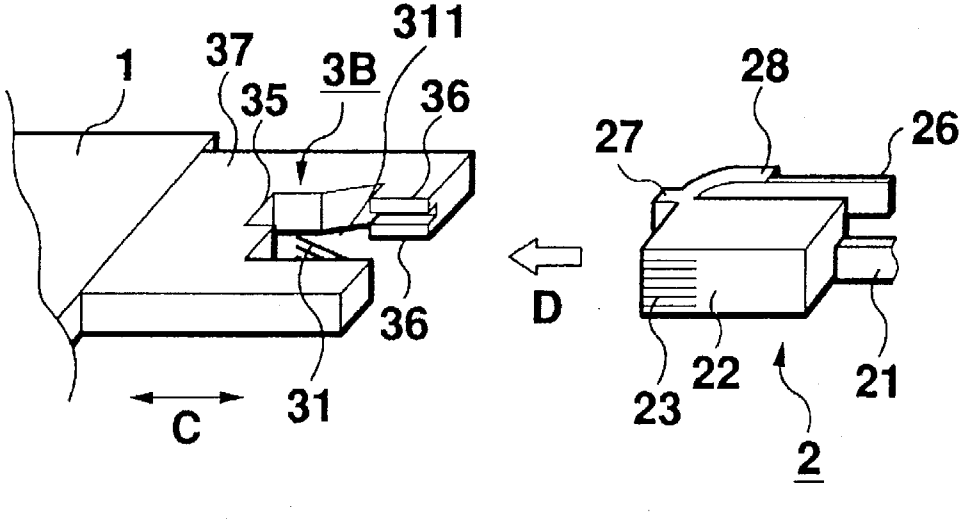

Prior to the description of the present invention, in order to clarify the effect of the present invention, description will be given of the configuration which has already been filed and published in Japan on May 12, 1995 (Japanese Utility-Model Laid-Open No. Hei 7-25654). Referring to FIGS. 1 to 3 there is depicted a configuration according to this application. It is to be noted that although in FIGS. 2 and 3 a PC card 1 and a retractable access portion 37 are shown having substantially the same thickness, the retractable access portion 37 actually has a thickness smaller than that of the PC card 1 since the retractable access portion 37 is accommodated in the interior of the PC card 1 as described hereinbelow.

Figure 51:
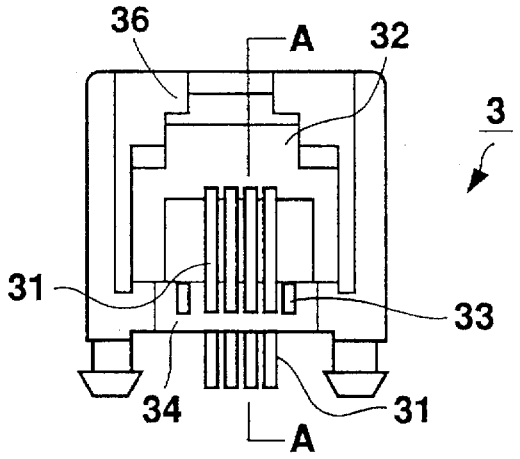
Fig. 51 PRIOR ART
FIG. 51 being a front elevational view showing the structure of the modular jack.
Figure 52:
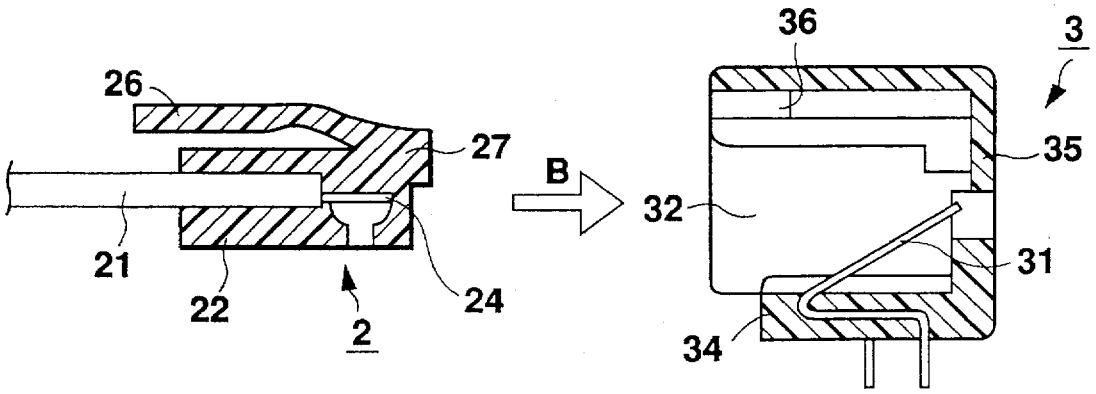
Fig. 52 PRIOR ART
FIG. 52 being a side sectional view showing the direction in which the modular plug is inserted into the modular jack, depicting a section taken along a line A—A, that is, a section including a contact wiring receiving groove.
Figure 53:
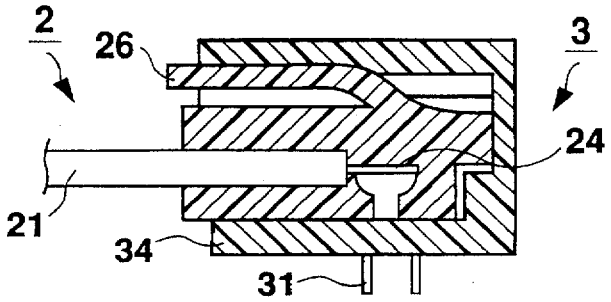
Fig. 53 PRIOR ART

In this embodiment, as shown in FIG. 1, a predetermined number of (two in the diagram) springs 15 are arranged within the interior of a jack chamber 14. The retractable access portion 37 is biased by the springs 15 from a jack slit 13 toward the exterior. Although not shown, a member for locking the position of the retractable access portion 37 is provided in the same manner as FIG. 54. The retractable access portion 37 is provided with a notch 311. The notch has a shape obtained by slicing a modular jack 3 shown in FIG. 51 along a plane parallel to an A—A section. The inner surface of the notch 311 is provided with contact wirings 31, a ledge 35 and a retention ridge 36, as shown in FIG. 2. Accordingly, while depressing a narrow free end 26, the modular plug 2 is inserted into the notch 311 along the direction D in FIG. 2 and lying sideways as shown in FIG. 2, thus realizing the coupling state as shown in FIG. 3. This coupling state will ensure the implementation of all four basic functions of the modular connector.

Figure 46:
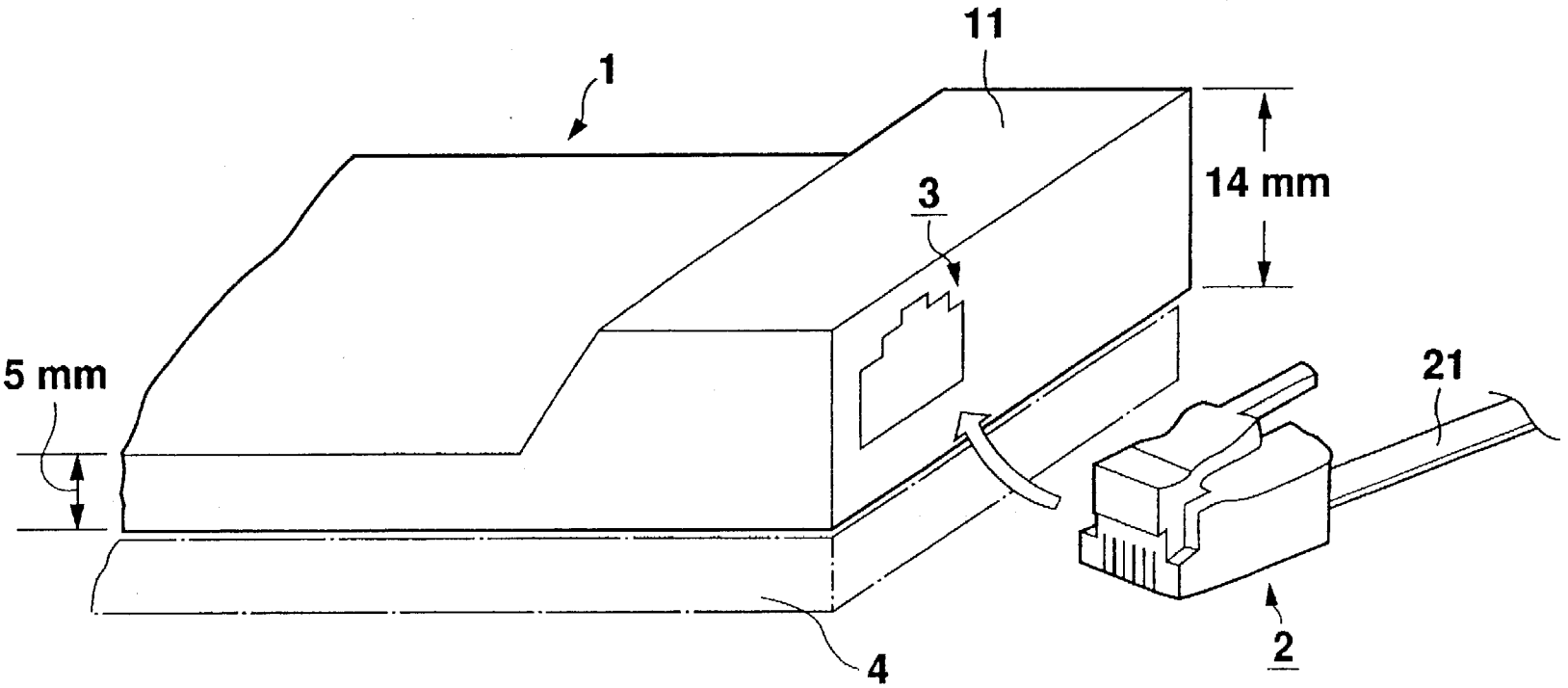
Fig. 46 PRIOR ART
FIGS. 46 and 53 illustrate a modular plug and a jack according to the prior art.
Figure 47:
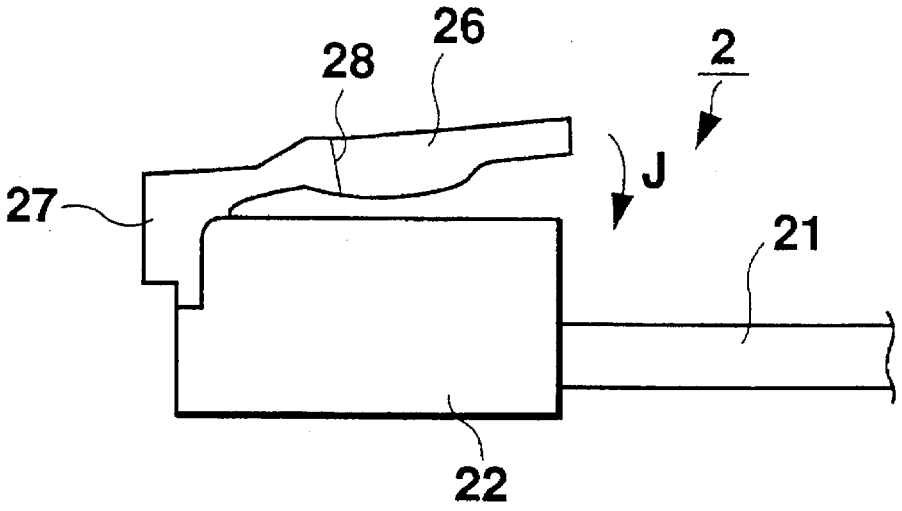
Fig. 47 PRIOR ART
FIG. 47 being a side elevational view of the modular plug with the narrow free end not forced.
Figure 48:
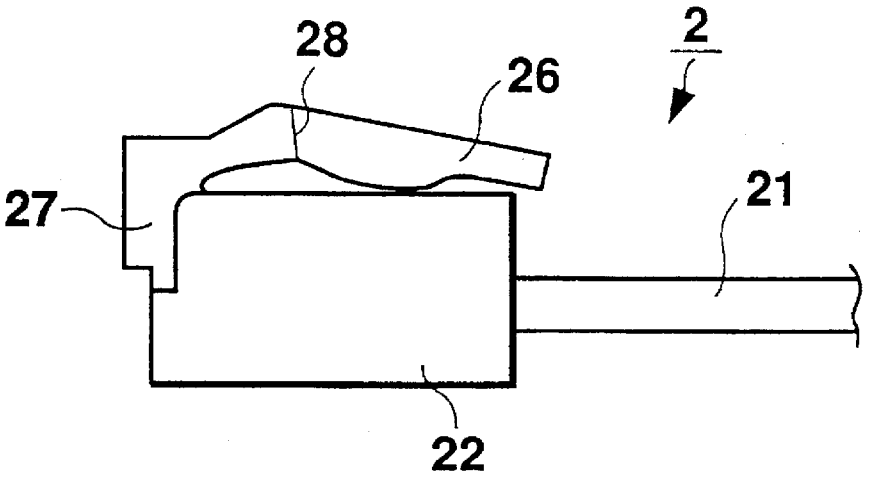
Fig. 48 PRIOR ART
FIG. 48 being a side elevational view of the modular plug with the narrow free end forced.
Figure 49:
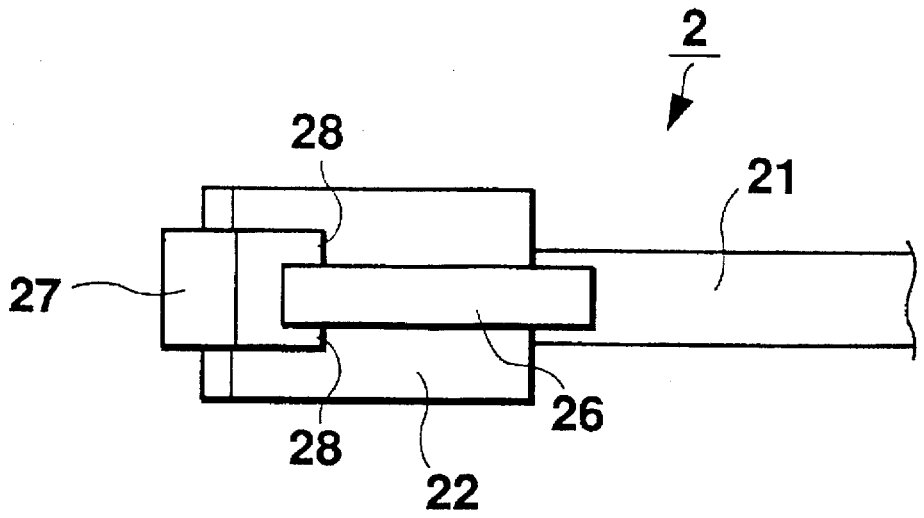
Fig. 49 PRIOR ART
FIG. 49 being a top plan view showing the structure of the modular plug.
Figure 50:
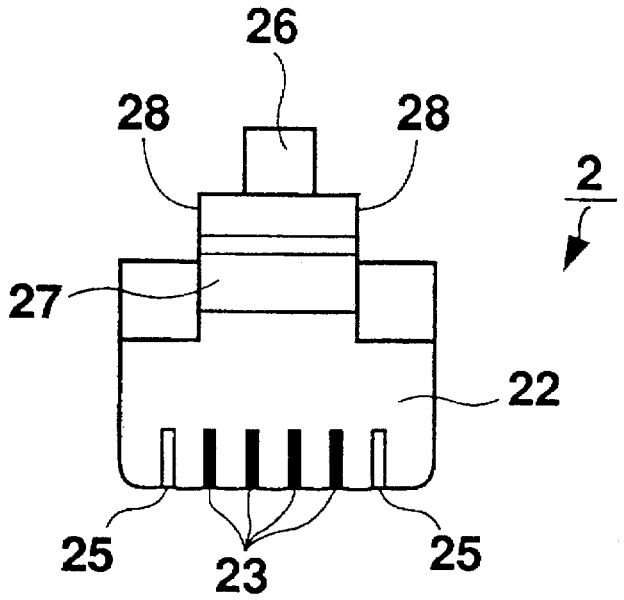
Fig. 50 PRIOR ART
FIG. 50 being a front elevational view showing the structure of the modular plug.
Figure 55:
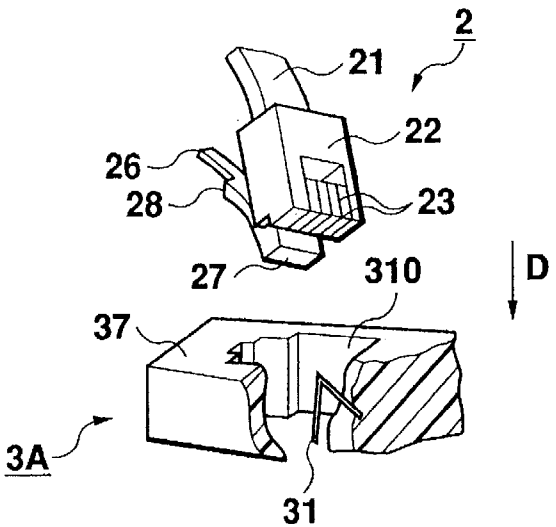
Fig. 55 PRIOR ART
FIGS. 54 to 57 illustrate an improved modular jack.

According to this configuration, there can be obtained substantially the same effect as in the structure shown in FIGS. 54 to 57 with respect to the structure shown in FIG. 46. In FIG. 55, the modular plug 2 had to be inserted into a straight aperture 310 along the direction substantially orthogonal to the major planes, which was a troublesome task. On the contrary, in this configuration, the modular plug can be inserted into the notch 311 from the direction parallel to the major planes, resulting in a simple operation. The structure shown in FIGS. 56 and 57 may be possibly used upside down, and in that case the modular plug 2 and the cord 21 may conflict with other objects (e.g., a desk or other cards). On the contrary, in this configuration, even though the structure is used with in orientation shown in FIGS. 2 and 3, or is used upside down, the modular plug 2 and the card 21 will not conflict with the other objects. Thus, this embodiment will ensure more secure and stable arrangement of the stations and stable actions of the cards.

Figure 57:
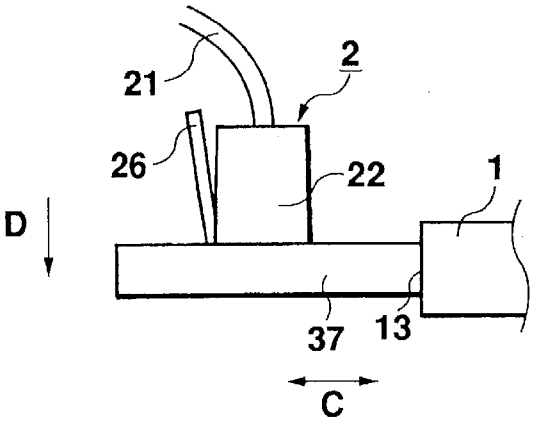
Fig. 57 PRIOR ART
Figure 56:
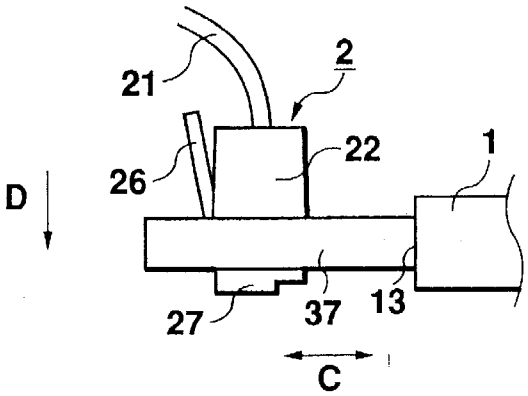
Fig. 56 PRIOR ART

Moreover, in FIGS. 56 and 57, the modular plug 2 and the cord 21 protruded in the direction substantially orthogonal to the major planes, and hence it was necessary to remove the modular plug 2 prior to the insertion of, e.g., a memory card 4 into the adjacent slot. In this embodiment, on the contrary, there is no necessity to do such a thing. Therefore, compared with the structure shown in FIGS. 54 to 57, the burden imposed on the user will be relieved. Also in this embodiment, the cord 21 extends in the direction substantially parallel to the major planes, resulting in a well-ordered arrangement of the cord 21 in the vicinity of the slot compared with FIGS. 56 and 57. This will prevent the cord 21 from becoming entangled with other cords or from conflicting with the other cards. Furthermore, in the structure shown in FIG. 55, the lower limit of the thickness of the retractable access portion was restricted by the length of the contact wirings 31 in order to ensure a sufficient contact length between the contact wirings 31 and contact pins 23. This embodiment does not have such a restriction and the thickness of the retractable access portion 37 can be designed more freely.

b) First Embodiment

Referring to FIG. 4 to 8, there is depicted a constitution of a modular jack 3G according to the first embodiment of the present invention. This embodiment has a configuration apparently extremely similar to that of the filed application shown in FIGS. 1 to 3, but differs in its functions and effects from that configuration.

Figure 4:
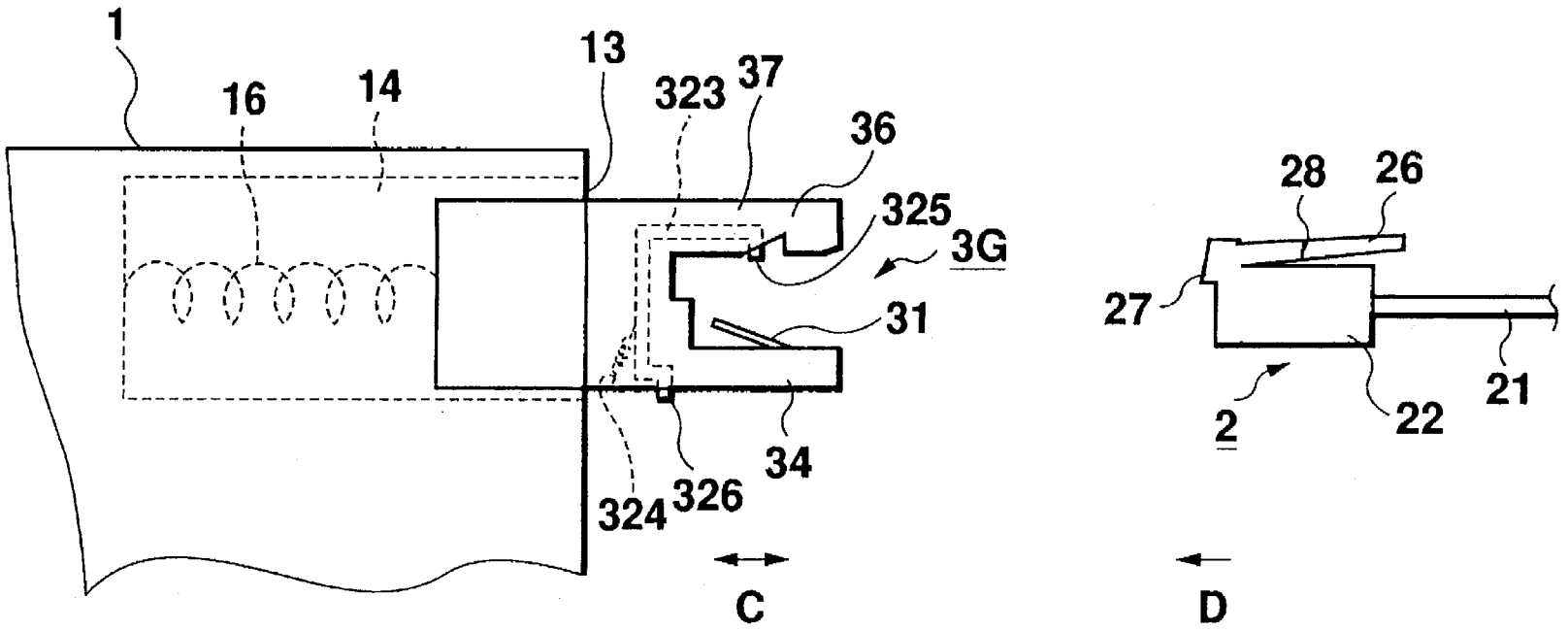
FIGS. 4 to 8 illustrate a modular jack according to the first embodiment, each depicting in phantom the interior of the PC card.
Figure 5:
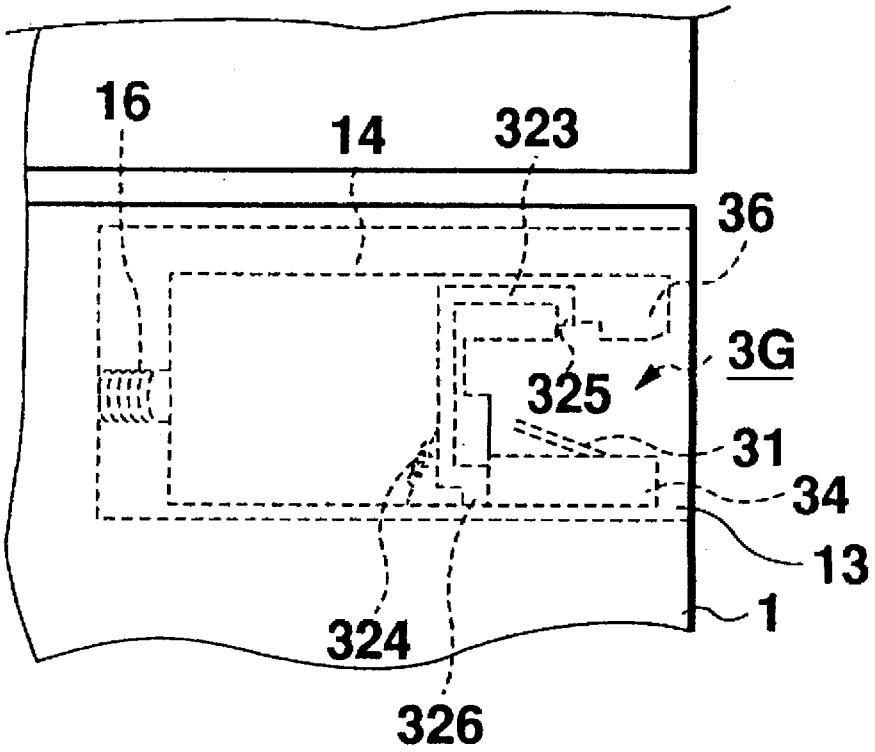

In this embodiment, as shown in FIG. 4, a predetermined number of (one in the diagram) spring(s) 16 is accommodated within the interior of a jack chamber 14. The retractable access portion 37 is biased by the spring 16 from the jack slot 13 toward the interior. That is, the spring 16 in this embodiment is a helical tension spring, different from the spring 15 serving as a helical compression spring in the first embodiment. The biasing force of the spring 16 is so set that the retractable access portion 37 can be accommodated in the jack chamber 14 as shown in FIG. 5.

A detection pin 325 is provided on the back of the retaining ridge 36, and a hook pin 326 is provided on the base of the side wall 34. The detection pin 325 is positioned so as to allow the application of a pressing force from the narrow free end 26 in the state where the retention ridge 36 is engaged with a transition notch 28. The detection pin 325 ordinarily protrudes from the surface of the retractable access portion 37, and when pressed by the narrow free end 26 is forced into the interior of the retractable free end 37.

The hook pin 326, on the other hand, is pressed by the inner wall of the jack chamber 14 in the state where the retractable access portion 37 is accommodated in the jack chamber and is forced into the interior of the retractable access portion 37. When the retractable access portion 37 is drawn out to the exterior of the jack chamber 14 by way of the jack slot 13, the hook pin 326 is released from the pressing action by the inner wall of the jack chamber 14. The interior of the retractable access portion 37 is provided with a spring 324 biasing the hook pin 326 toward the exterior of the retractable access portion 37. Thus, with the release from the pressing action by the inner wall of the jack chamber 14, the spring 324 forces the hook pin 326 to protrude from the surface of the retractable access portion 37.

The interior of the retractable access portion 37 is further provided with a cooperation plate 323 serving as a member for causing the detection pin 325 and the hook pin 326 to cooperatively act. More specifically, when the detection pin 325 is pressed by the narrow free end 26 of the modular plug 2, the cooperation plate serves to draw the hook pin 326 into the interior of the retractable access portion 37.

Figure 6:
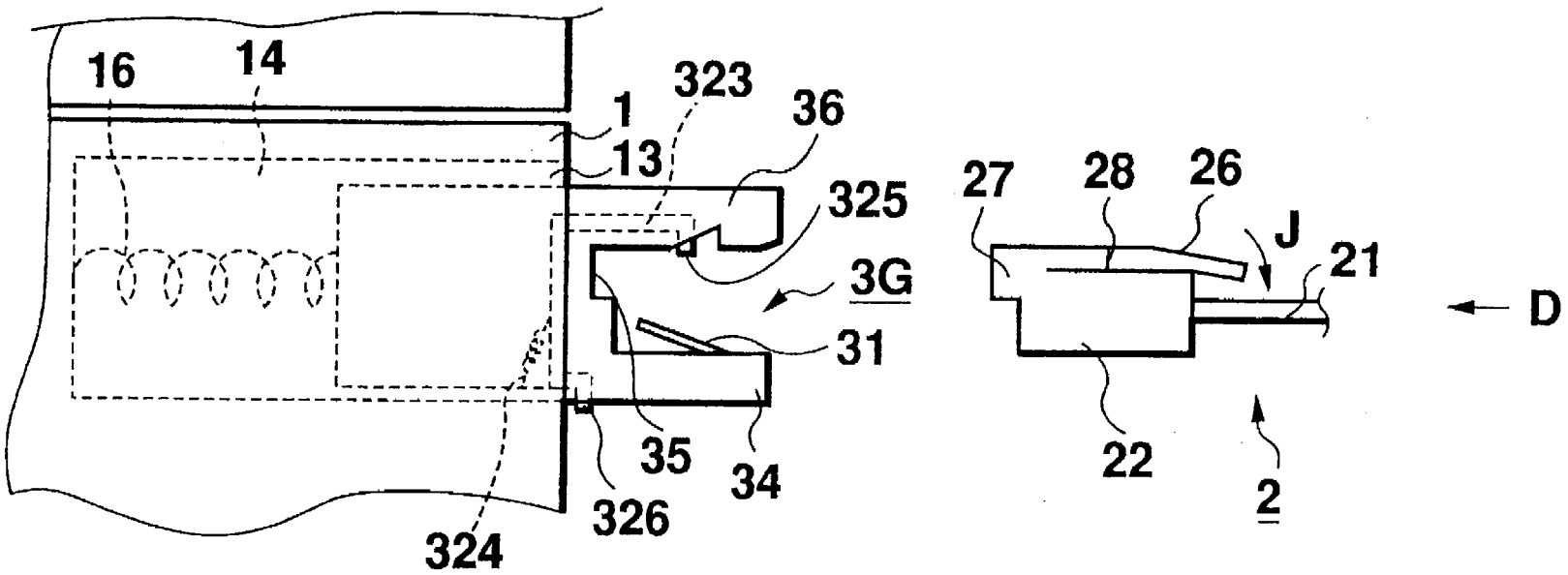
Figure 7:
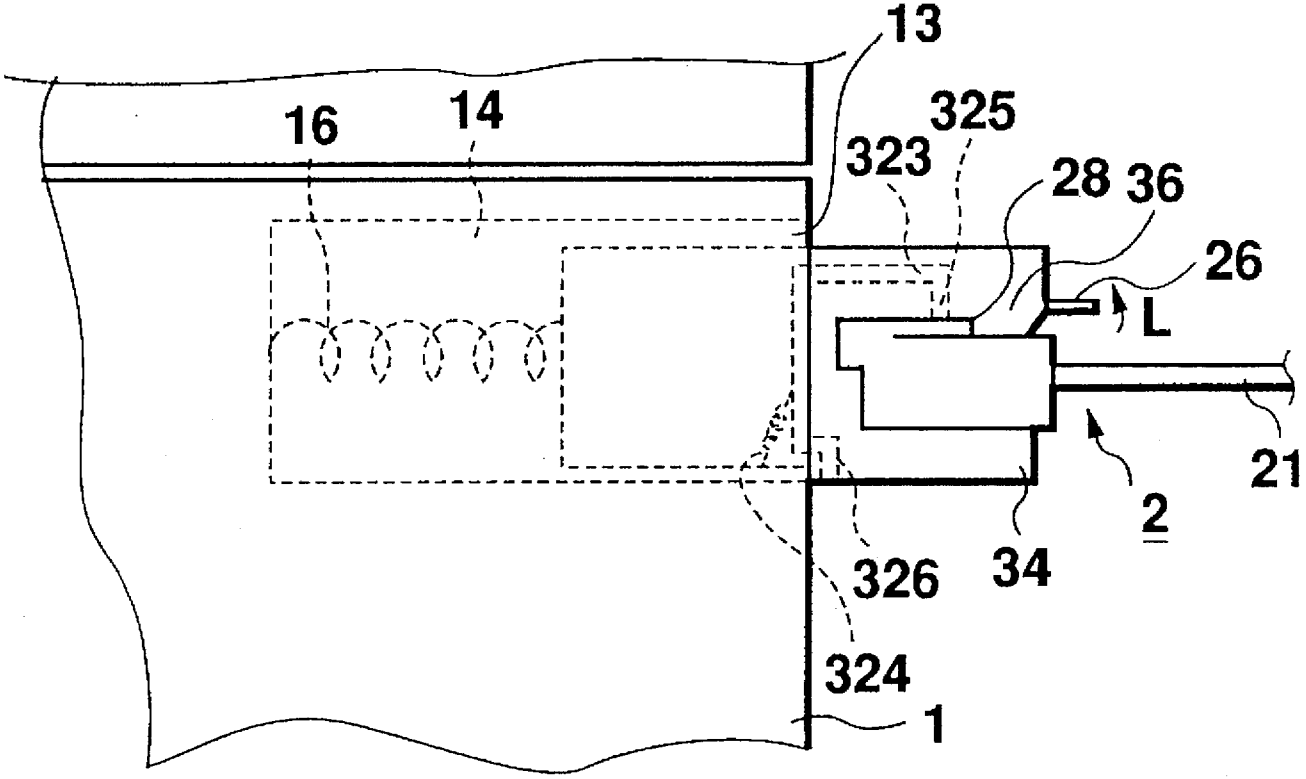
Figure 8:
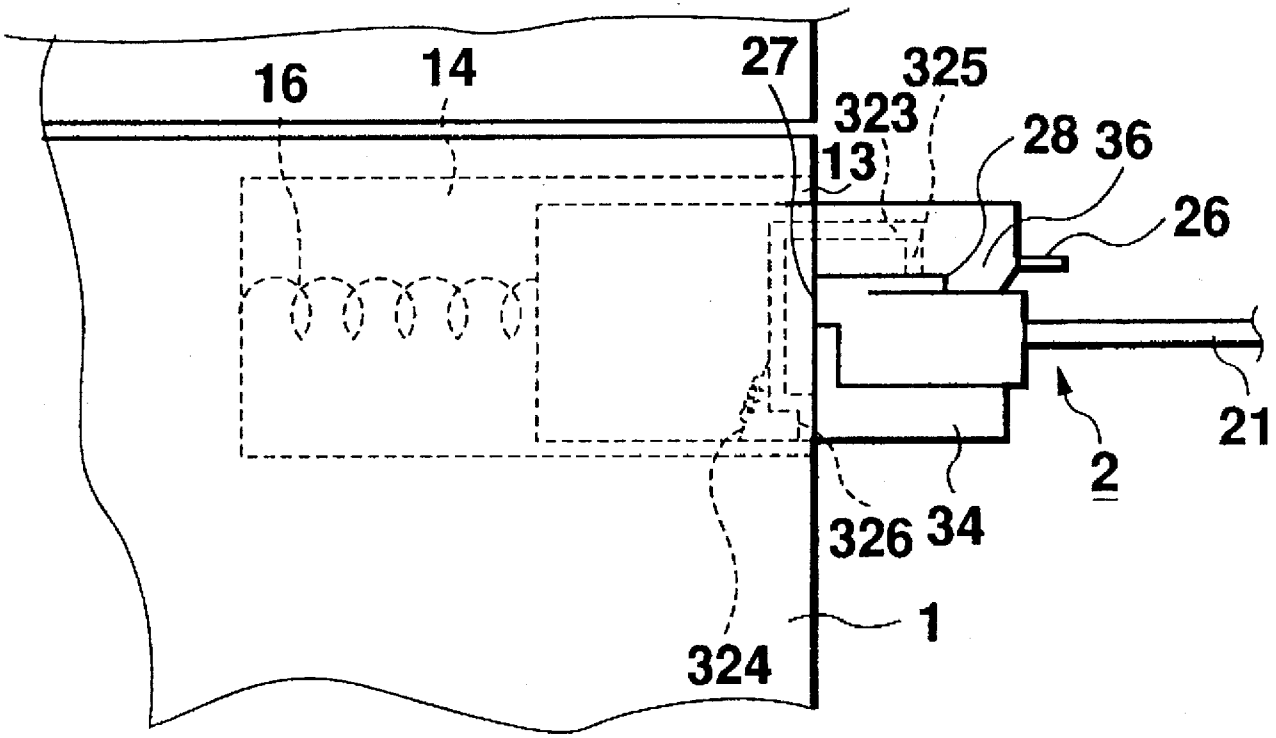

At the time of inserting the modular plug 2 into the modular jack 3G, the retractable access portion 37 is drawn out from the state shown in FIG. 5. When the retractable access portion is drawn out to the exterior of the jack chamber 14, the hook pin 326 protrudes and is allowed to engage with the aperture end of the jack slot 13 as shown in FIG. 6. As a result of this, the retractable access portion 37 is positionally fixed in the state of being drawn out to the exterior of the jack chamber 14. By inserting the modular plug 2 into the modular jack 3G along the direction D while depressing the narrow free end 26 in the direction indicated by J in FIG. 6, there are exerted an electrically coupling function, an inserting direction regulation function, an insertion stopping function and a returning prevention function in the same manner as the first embodiment. Simultaneously, the narrow free end 26 is rotationally recovered in the direction L to press the detection pin 325, allowing the cooperation plate 323 to draw the hook pin 326 into the interior of the retractable access portion 37 as shown in FIG. 7. Thereupon, the engagement of the hook pin 326 with the aperture end of the jack slot 13 is released. Nevertheless, the whole of the retractable access portion is not drawn into the jack chamber 14. This arises from the fact that the engagement of the broad fixed end 27 of the modular plug 2 with the aperture end of the jack slot 13 prevents the recovery (that is, accommodation) of the retractable access portion 37. This results in the state as shown in FIG. 8.

According to this embodiment, there can be obtained substantially the same effect as in the configuration of FIGS. 1 to 3. Moreover, upon the removal of the modular plug 2 from the modular jack 3G, the whole of the retractable access portion is drawn into the jack chamber 14 by merely depressing the narrow free end 26 to the direction J. This means that this embodiment presents a good operability (with one action) compared with the configuration of FIGS. 1 to 3 in which the user had to perform an operation forcing the retractable access portion 37 thereinto. In the configuration of FIGS. 1 to 3, there was a possibility that the retractable access portion 37 might impinge on other objects and be damaged if the user forgot to perform the operation forcing the retractable access portion thereinto. However, this embodiment is free from such situations and hence is advantageous over the configuration of FIGS. 1 to 3 in view of the prevention of accidents and in reliability. In addition, if the load to be imposed on the station-side connector in the interior of the slot by the operation of forcing in the retractable access portion 37 by fingers is compared with the load attendant on the operation of forcing in the retractable access portion 37 with the helical tension spring, the former will be larger than the latter. Thus, this embodiment will ensure longer life of the station-side connector.

It is preferable, in the configuration of FIGS. 1 to 3 making use of the spring 15 serving as a helical compression spring, to provide shafts or tubes for guiding the motion of the spring 15. In contrast, this embodiment employs the spring 16 serving as a helical tension spring, enabling the action accommodating the retractable access portion to be performed by the recovering force of the spring 16, thus eliminating the necessity for the shafts or tubes. Furthermore, the retractable access portion was accommodated against the biasing force of the spring 15 in the configuration of FIGS. 1 to 3, whereas the accommodation of the retractable access portion is exclusively dependent on the biasing force of the spring 15 in this embodiment. Accordingly, the load imposed on the spring during the accommodation (that is, wear of the spring during the accommodation) in this embodiment is less than that in the configuration of FIGS. 1 to 3. Taking into consideration that the plug connection period is typically longer than the plug disconnection period, it can be said that the life of the spring 16 is longer than that of the spring 15.

Figure 54:
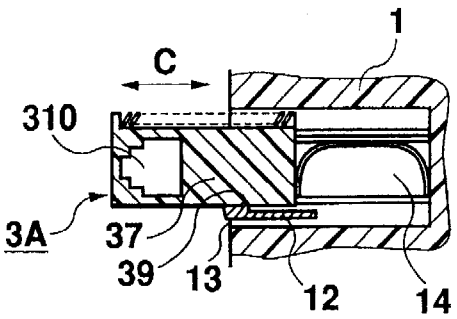
Fig. 54 PRIOR ART

Also, both the configuration of FIGS. 1 to 3 and this embodiment make use of an engagement structure for retaining the state where the retractable access portion 37 protrudes to the exterior of the PC card 1 (the engagement structure of FIG. 54 in the configuration of FIGS. 1 to 3; the structure engaging hook pin 326 and broad fixed end 27 with the slit aperture end in this embodiment). However, the two embodiments employ the springs having a different function, that is, the helical compression spring and the helical tension spring, respectively. Accordingly, there is a difference between the two configurations that in the configuration of FIGS. 1 to 3, if a failure or disorder occurs in the engagement structure, the retractable access portion is not accommodated and is apt to be damaged in a collision with other objects, whereas this embodiment is free from such a situation. In other words, it can be said that this embodiment has a higher reliability with respect to the failure or disorder of its engagement structure.

c) Variant of First Embodiment

Figure 9:
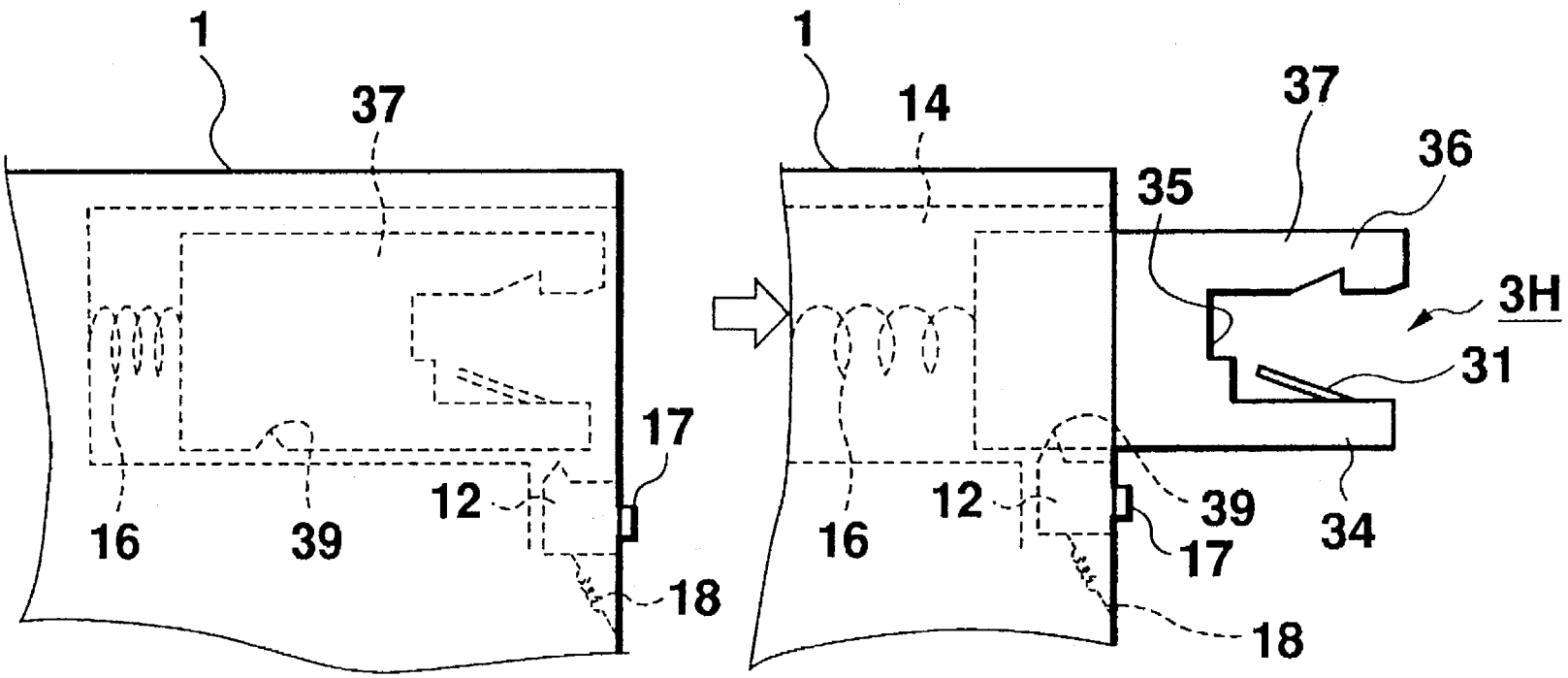
FIGS. 9 to 11 illustrate a variant of a modular jack according to the first embodiment, each depicting in phantom the interior of the PC card.
Figure 11:
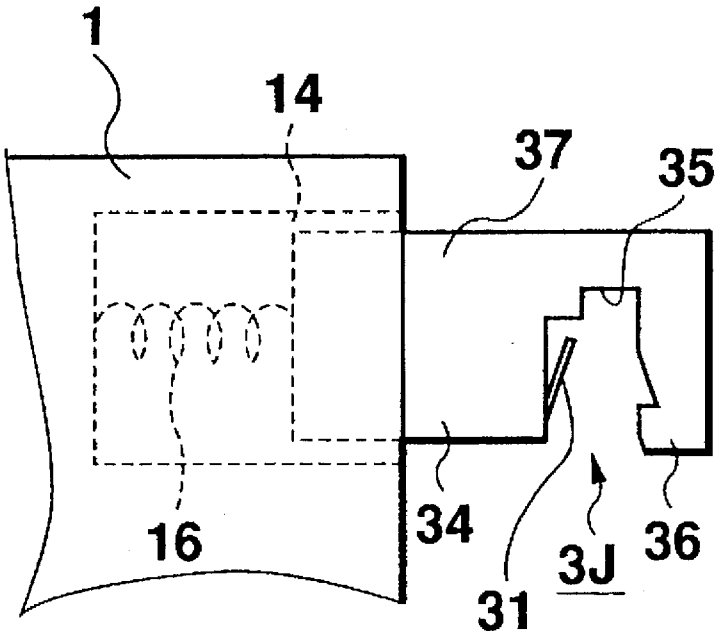
Figure 10:
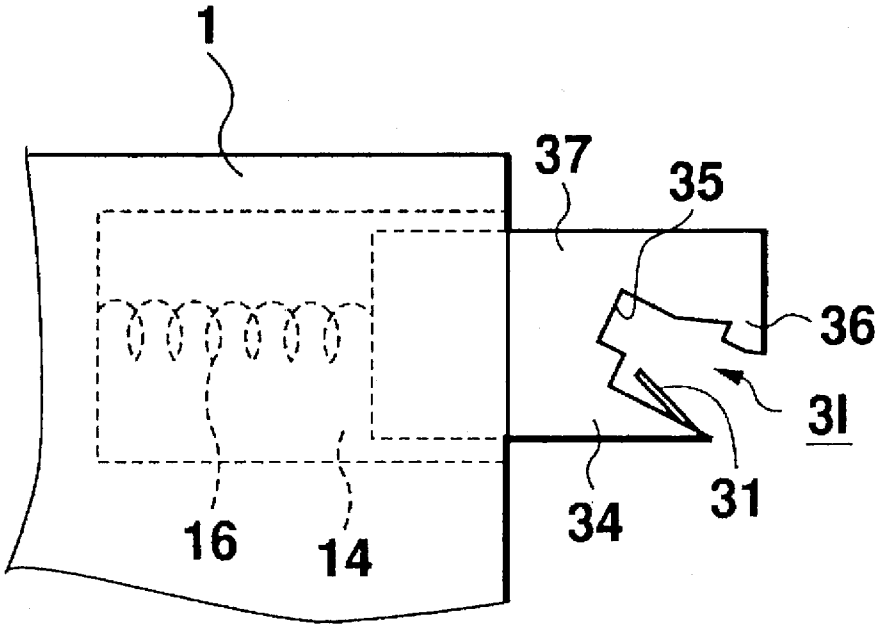

The first embodiment can be variously modified. For instance, a modular jack 3H shown in FIG. 9 is provided with an engagement structure identical or similar to that in FIG. 54 and with a switch 17 operated by the user for its engagement or release. Denoted in the diagram by reference numeral 18 is a spring biasing a lever 12 upward or downward. However, the configuration depicted in FIGS. 4 to 8 is advantageous in operability or other aspects. Also, modular jack 3I and 3J depicted in FIGS. 10 and 11, respectively, will allow the modular plug 2 to be inserted from the direction different from the inserting direction in FIG. 4. It will be appreciated that although the engagement structure is not shown in FIGS. 10 and 11, it may be the structure shown in FIG. 4 or FIG. 9.

d) Second Embodiment

Figure 12:
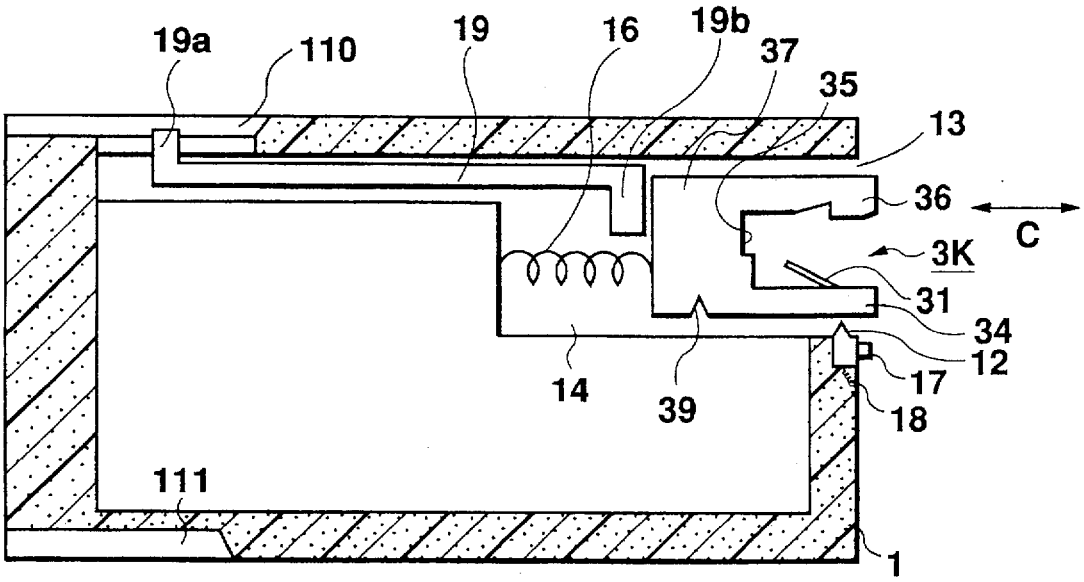
FIGS. 12 to 16 illustrate a modular jack according to the second embodiment of the present invention, each depicting in phantom the interior of the PC card.
Figure 13:
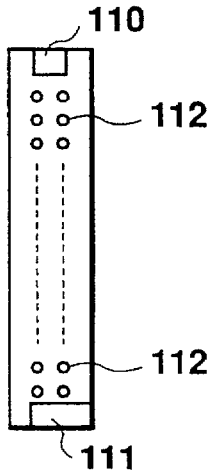

Referring to FIGS. 12 to 16 there is depicted the configuration of the second embodiment of the present invention. A modular jack 3K according to this embodiment employs a spring 16 similar to the first embodiment and an engagement structure similar to that in FIG. 9. In comparison with the first embodiment, this embodiment is characterized in that a plate-like 19 rod is arranged within the PC card 1. As seen in FIG. 12, the rod 19 is provided so as to be slidable along the longitudinal direction of the PC card 1 (direction C in FIG. 12). Both ends **19*a* and 19*b* of the rod 19 are bent in opposite directions to each other. One end 19*a* is extended to the interior of a guide track 110, while the other end 19*b* abuts against one edge of the retractable access portion 37 closer to the spring 16. In addition to the guide track 110, the PC card has another guide track 111. As is apparent from FIGS. 12 and 13, the guide tracks 110 and 111 are respectively arranged so as to confront two edges each facing the other along the direction C in FIG. 12, among four edges of the PC card 1. The guide tracks 110 and 111 have sectional shapes different from each other as shown in FIG. 13 and open to the side of the edge confronting the edge on which the jack slit 13 is formed, among the remaining two edges. On this edge are formed a plurality of pin sockets 112** in alignment.

Figure 14:
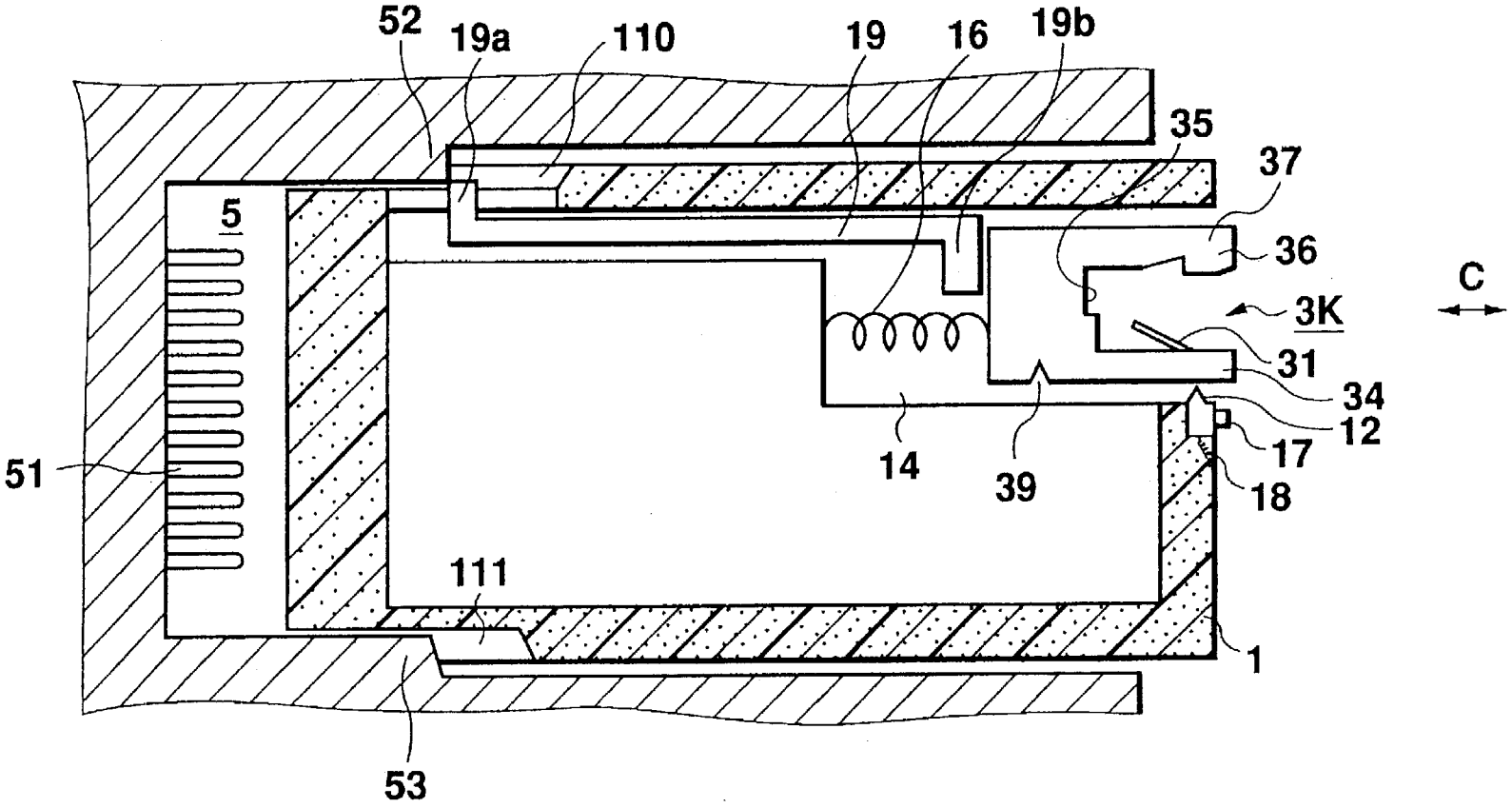
Figure 15:
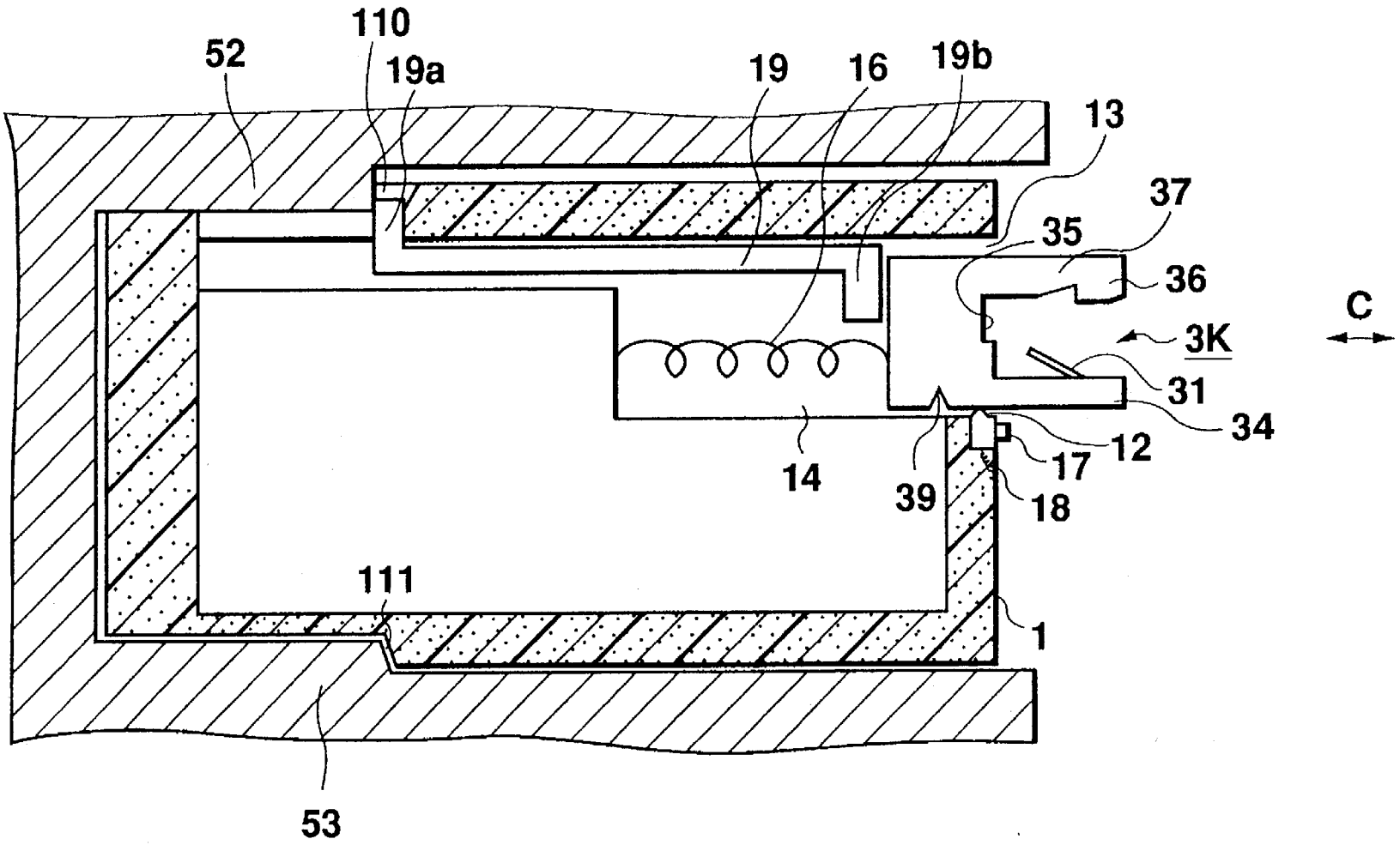
Figure 16:
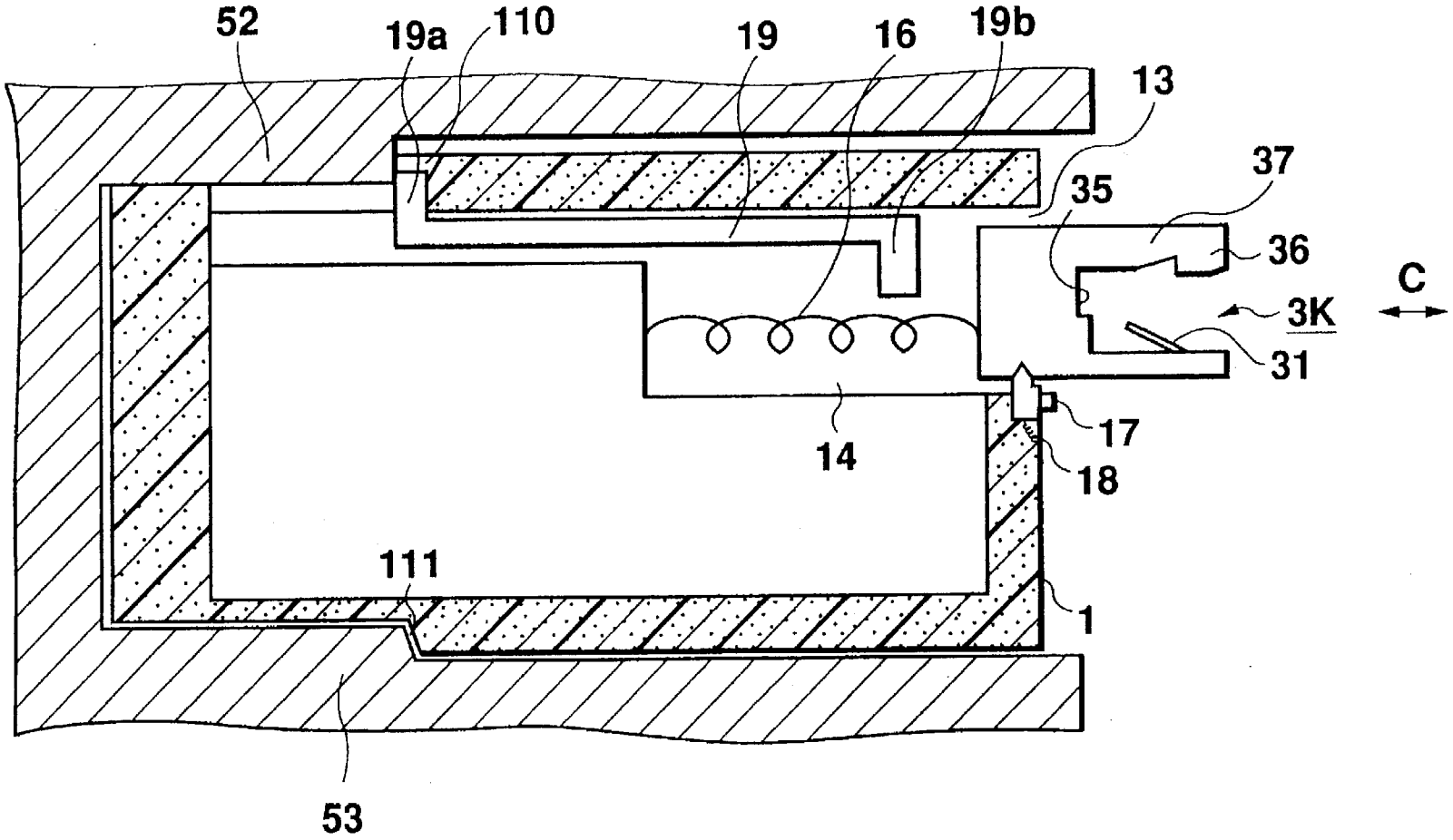

On the far side of the slot 5 of the station, a plurality of pins 51 are formed in alignment as shown in FIGS. 14 to 16. The pin sockets 112 each correspond to any one of the pins 51. When the PC card 1 is inserted into the slot 5, the corresponding pins 51 enter the associated pin sockets 112. Although in FIGS. 14 to 16 the internal circuit of the PC card 1 is not shown for the simplicity of the diagrams, sufficiently deep insertion of the pins into the pin sockets will allow the internal circuit to electrically couple with the station side circuit.

In order to obtain such electrical coupling, it is necessary for the PC card 1 to be inserted into the slot 5 in a correct direction and with a correct orientation. In cooperation with the keys 52 and 53 formed in the slot 5, the guide tracks 110 and 111 will regulate the direction in which the PC card 1 is inserted and the posture of the PC card 1. The keys 52 is a protrusion configured to be capable of meshing with the guide track 110 but incapable of meshing with the guide track 111, whereas the key 53 is a protrusion configured to be capable of meshing with the guide track 111 but incapable of meshing with the guide track 110. The key 52 and 53 are both formed on the far side of the slot 5 along the direction C. Therefore, in spite of any attempts to insert the PC card 1 into the slot 5 in incorrect direction or with an incorrect orientation, the pins 51 are not permitted to be deeply inserted into the sockets 12 due to the presence of the keys 52 and 53 which in this case act as obstacles. On the contrary, if the PC card 1 is inserted into the slot 5 in a correct direction and with a correct orientation, the pins 51 are permitted to be sufficiently deeply inserted into the pin sockets 112. In this case, the keys 52 and 53 play positive roles to guide the PC card 1 and to maintain the orientation of the PC card 1, instead of being obstacles.

The one end **19*a* of the rod 19 in this embodiment is so provided as to engage with the key 52 if the PC card 1 is inserted into the slot 5 in correct direction and posture. That is, when inserting the PC card 1 into the slot 5 in a correct direction and orientation, the approach of the end 19***a* is blocked by the end of the key 52 as shown in FIG. 14, and hence the retractable access portion 37 is squeezed by the end 19*b* to the exterior of the PC card 1 while resisting the biasing force of the spring 16. Thus, under the condition where the PC card 1 has been completely inserted into the slot, at least a part of the retractable access portion 37, e.g., the part in the order of 5 mm protrudes to the exterior of the jack slot 13 as shown in FIG. 15. When the user pinches and pulls out with his fingers the part of the retractable access portion protruding to the exterior of the jack slit 13, the position of the retractable access portion 37 is fixed upon the engagement of the lever 12 with the limiting notch 39 as shown in FIG. 16.

On the contrary, in the case where it is necessary to remove the PC card 1 from the slot 5, the state of FIG. 16 can be shifted to the state of FIG. 15 by disengaging the lever 12 from the limiting notch 39 by operation of the switch 17. Afterwards, from the state of FIG. 15 the PC card 1 is pulled out of the slot 5 by known means (not shown as is apparent to those skilled in the art). In this embodiment, due to the spring 16 which is a helical tension spring, upon pulling out, the retractable access portion 37 is automatically accommodated within the PC card 1 with the aid of the biasing force of the spring 16.

According to this embodiment in this manner, there can be obtained the same effect as in the second embodiment. In addition, the instant the PC card is inserted into the slot 5, a part of the retractable access portion 37 is automatically drawn out, contributing to the improvement in the operability.

e) Variant of Second Embodiment

Figure 17:
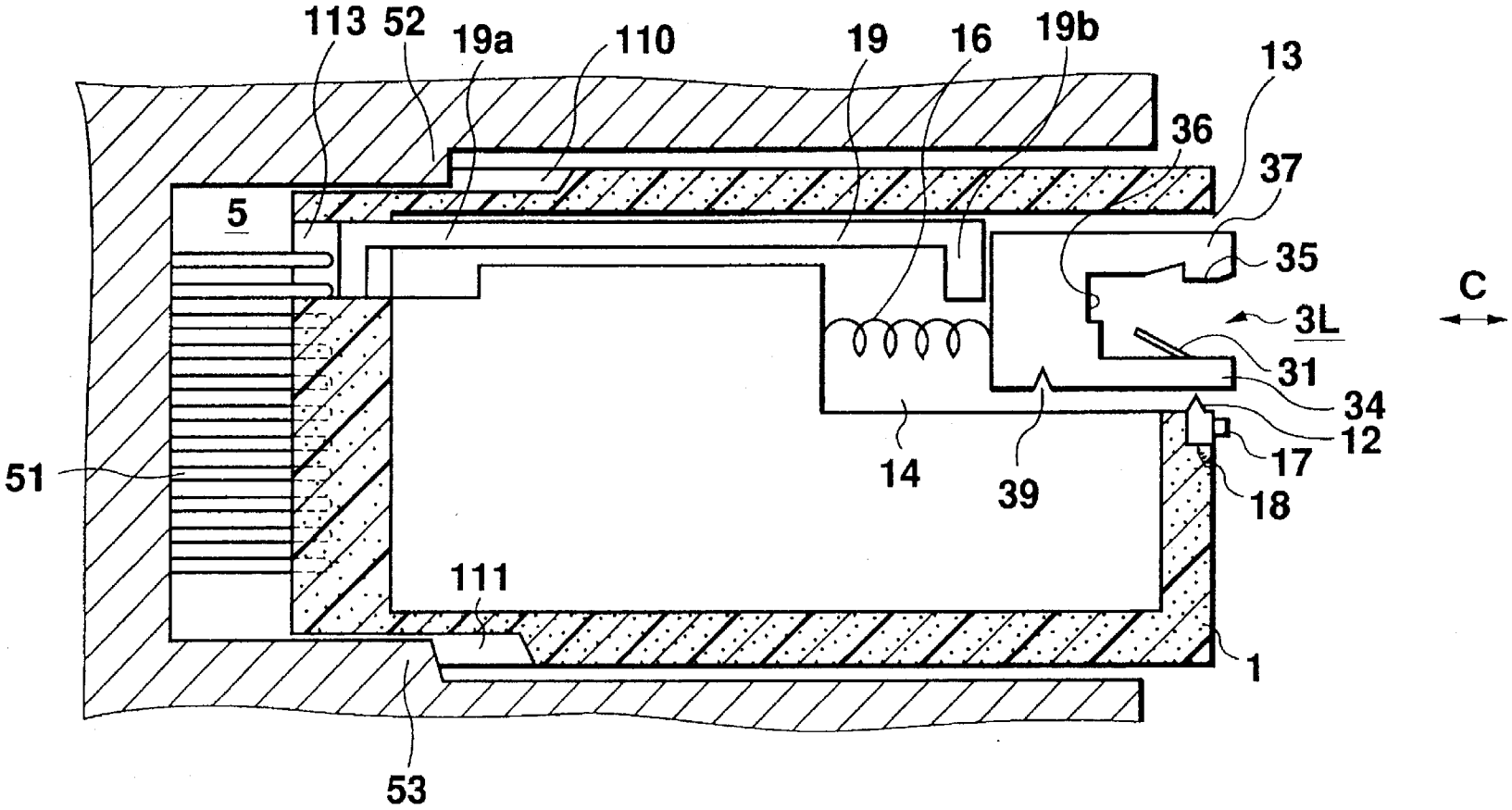
FIGS. 17 and 18 illustrate a variant of the modular jack according to the second embodiment of the present invention, with the internal circuit of the PC card omitted.
Figure 18:
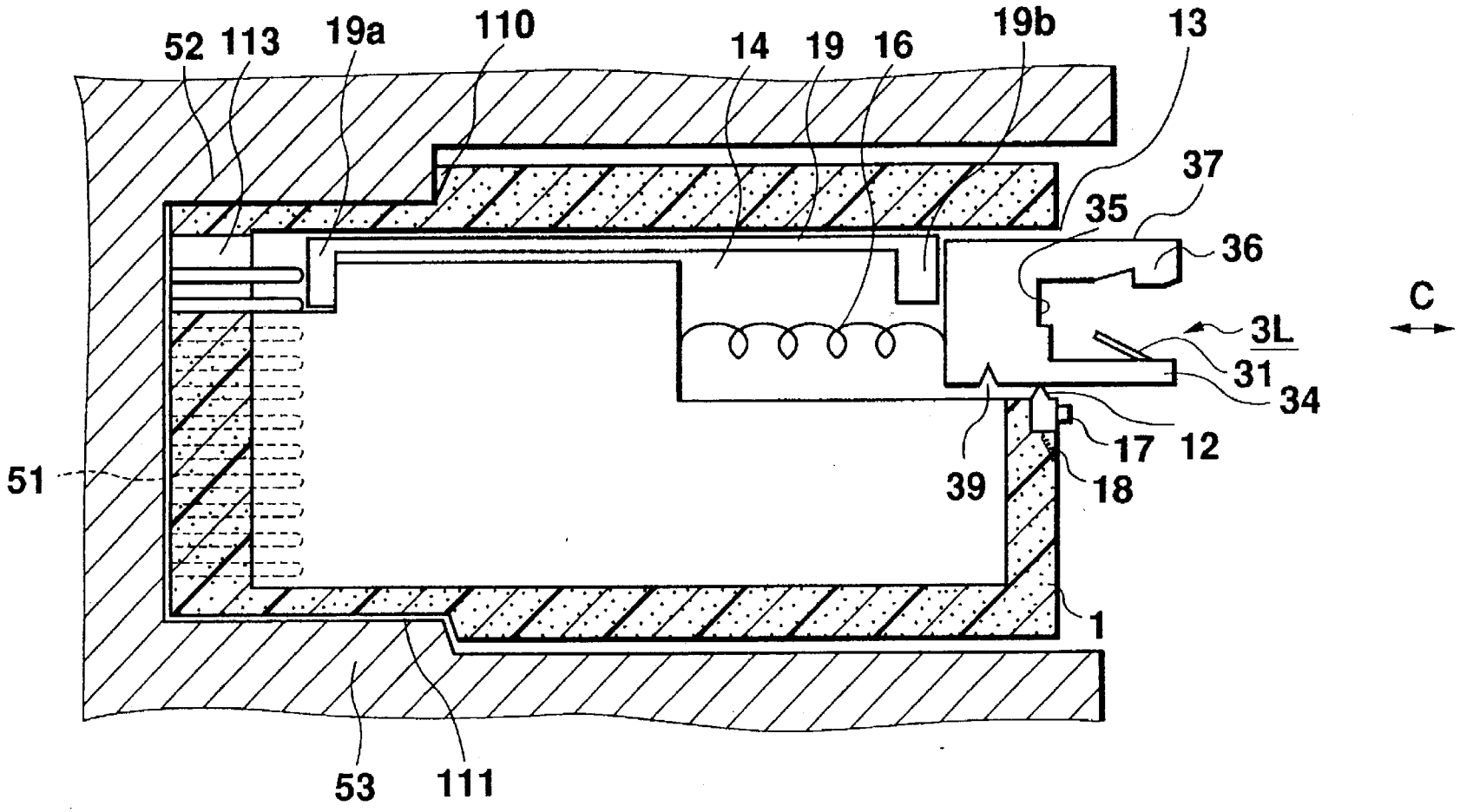

In the second embodiment, the rod 19 was forced toward the direction of the retractable access portion 37 by the engagement of the one end 19*a* of the rod 19 with the key 52. However, the second embodiment is not intended to be limited to such a configuration making use of the key 52 in this manner. In a modular jack 3L shown in FIGS. 17 and 18, by way of example, both the ends 19*a* and 19*b* of the rod 19 are bent in the same direction, the end 19*a* being extended to the exterior the pin socket 112 not shown. Accordingly, in this variant, e.g., two of the pins 51 push the end 19*a*, thereby urging the rod 19 toward the direction of the retractable access portion 37. Designated in the diagram at reference numeral 113 is a notch providing a space allowing the end 19*a* to slide.

This variant is advantageous in that the end 19*a* is not seen from the exterior, contributing to a better appearance. However, the pin pushing the end 19*a* among the pins 51 is required to have sufficient rigidity.

Although in FIG. 12 the one end 19*a* of the rod 19 was extended to the interior of the guide track 110, it may be extended to the interior of the guide track 111 or alternatively may be extended to the interiors of both of the guide tracks 110 and 111.

f) Third Embodiment

Figure 19:
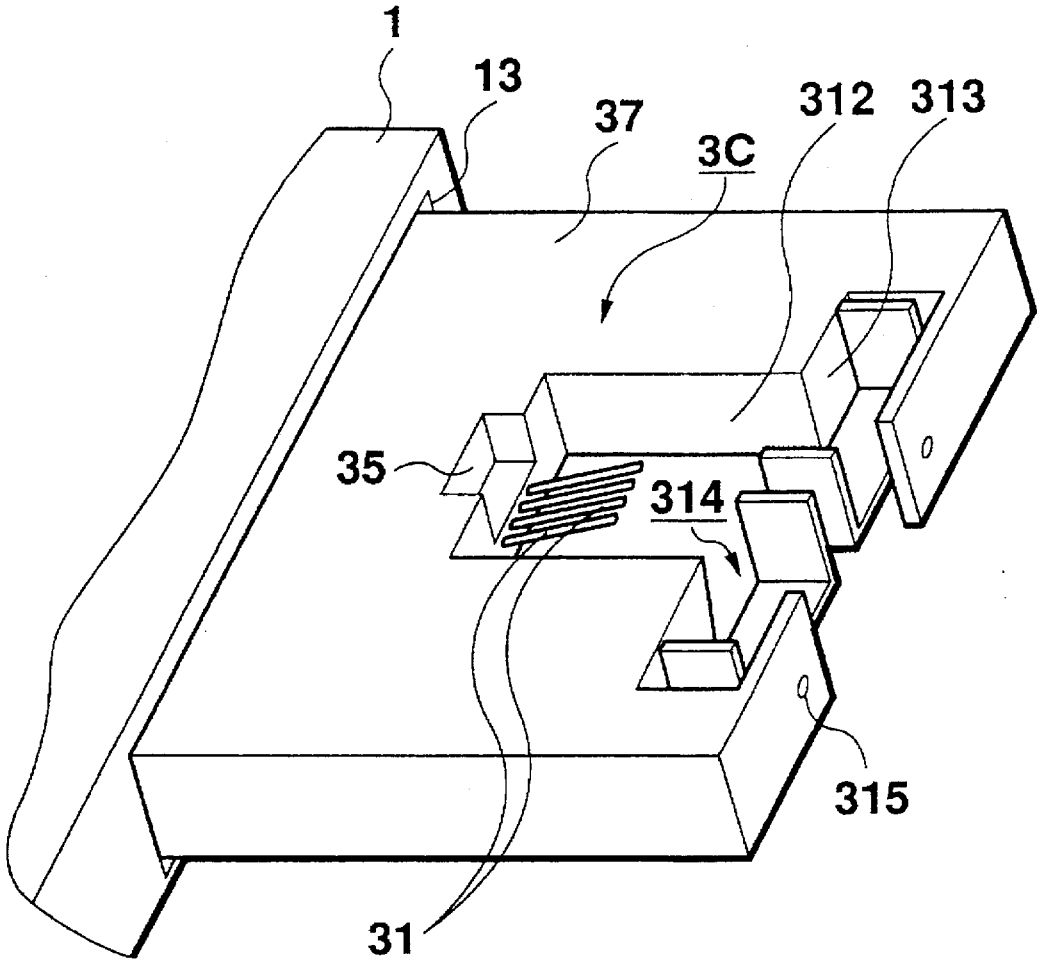
FIGS. 19 to 21 illustrate a modular jack according to the third embodiment of the present invention.
Figure 20:
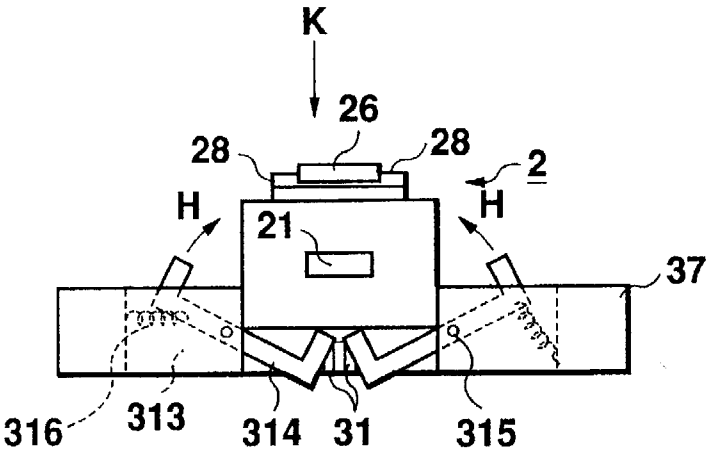
Figure 21:
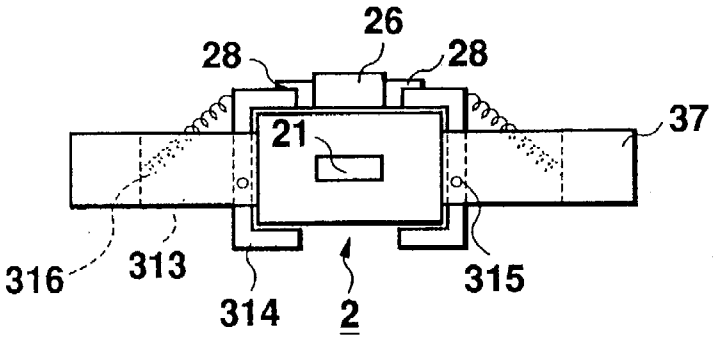

Referring to FIGS. 19 to 21 there is depicted a configuration of the third embodiment. This embodiment also employs, for example, a structure not shown for accommodating and retaining the retractable access portion similar to that in the first embodiment.

As shown in FIG. 19, the retractable access portion 37 is provided with a notch 312. The notch has a shape obtained by slicing the modular jack 3 shown in FIG. 51 along the planes orthogonal to the A—A section. While depressing the narrow free end 26, the modular plug 2 is inserted along the direction K in FIG. 20 and with the face opposite to the narrow free end 26 positioned forwardly. At that time, the inner surface of the notch 312 serves to guide the modular plug 2. That is, by configuring the notch in this manner, this embodiment implements its inserting direction regulation function. Also, the inner surface of the notch 312 is provided with contact wirings 31 and a ledge 35 as shown in FIG. 19. Upon insertion of the modular plug 2 into the notch 312, the contact wirings 31 are brought into contact with the contact pin 23, whereby this embodiment implements its electrically coupling function. To the right and left of the aperture of the notch 312 are disposed a couple of holder chambers 313. Each holder chamber 313 accommodates a holder 314. Each holder 314 is of U-shape with two arms and is supported by the inner wall of the holder chamber 313 by means of a pin 315 so as to be able to rotate on the pin 315 in the direction H in FIG. 20. After the insertion of the modular plug 2, it is supported by these holders 314 as shown in FIG. 21. The shape of the inner surface of the holder 314 or the shape of the arms are designed so as to provide the insertion stopping function and returning prevention function (as well as a part of the inserting direction regulation function) by such a retaining action. This embodiment does not need the retention ridge 36.

According to this embodiment, substantially the same effect as in the first embodiment can be obtained. Additionally, in this embodiment, the arm positioned on the far side of the holder chamber 313, of the two arms of each holder 314, is intended to be supported by the inner surface of the holder chamber 313 by means of the spring 316. Therefore, with the modular plug 2 removed, the holders 314 are accommodated in the corresponding holder chambers 313, so that the holders 314 can not protrude from the corresponding holder chambers 313 under such a condition. Thus, the holder is scarcely damaged. Furthermore, the spring 316 is not subjected to any burden during when the plug is not inserted, contributing to the life of the spring 316.

g) Fourth Embodiment

Referring to FIGS. 22 to 27 there is depicted a configuration of the fourth embodiment of the present invention. This embodiment also employs, for example, a structure not shown for accommodating and retaining the retractable access portion similar to the first embodiment.

Figure 22:
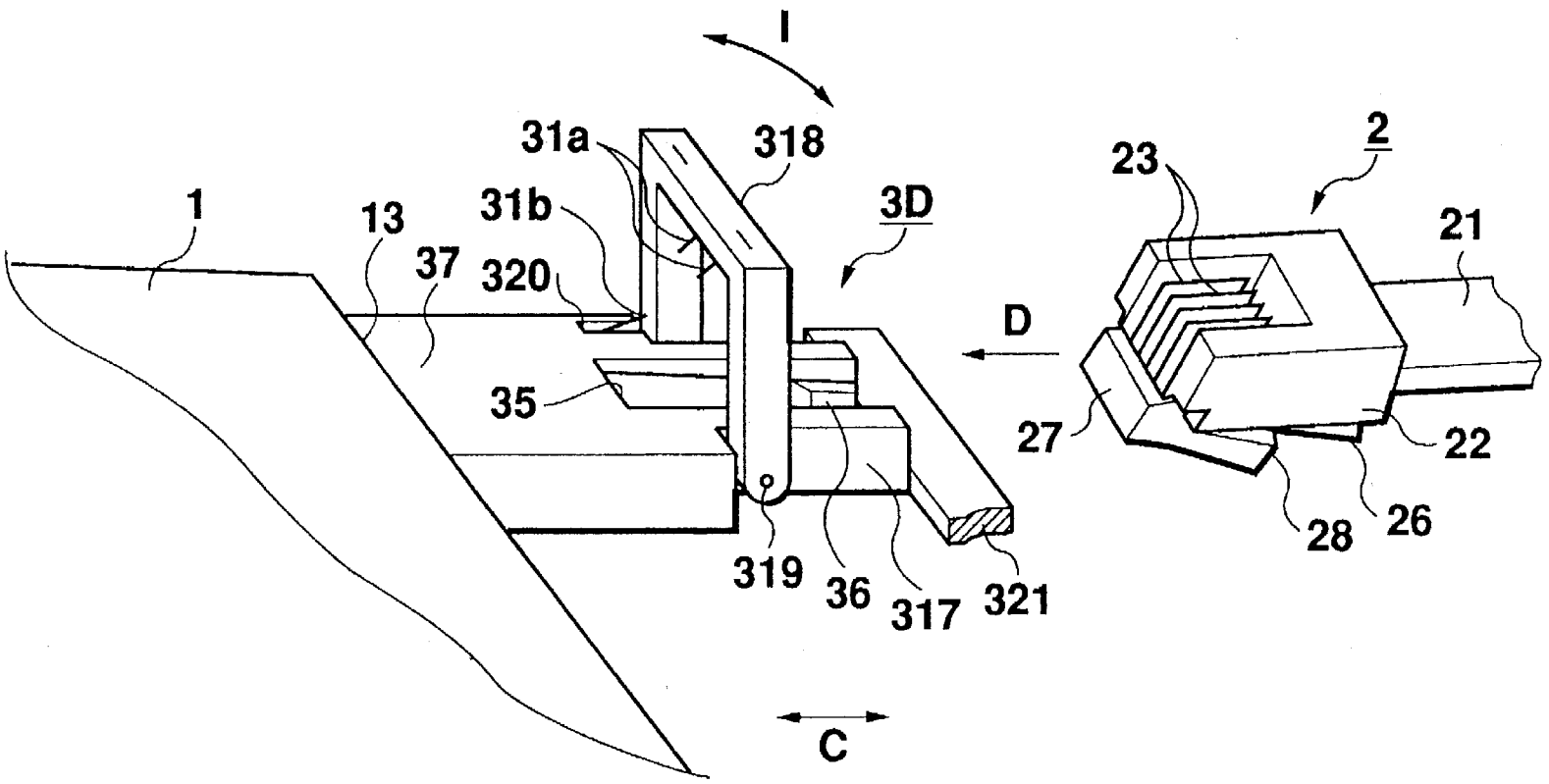
FIGS. 22 to 27 illustrate a modular jack according to the fourth embodiment of the present invention.

In this embodiment, the modular plug 2 is inserted into a modular jack 3D along the direction D and with the face opposite to the narrow free end 26 upward, as shown in FIG. 22. Extending in parallel with one another, from one end of theretractable access portion 37, are a couple of support arms 317, as shown in FIG. 22. The width and length of the support arms 317 and the interval between the two support arms are so determined as to be able to support the modular plug 2 being inserted in the above-described manner and not to allow the contact pin block 22 and the narrow free end 26 to protrude downward in FIG. 22 during the support of the modular plug 2. U-shaped support stirrups 318 each having two arms are supported by the outer wall of the support arms 317 by means of a pin 319 so as to be rotatable on the pin 319 in the direction I in FIG. 22. The dimensions of the support stirrup 318, in particular, the dimensions of the inner surface are so set as to able to receive the modular plug 2 in an upright state as shown in FIG. 22 and to be able to hold the modular plug 2 in cooperation with the support arm 317. That is, this embodiment implements its inserting direction regulation function with the aid of the support arm 317 and the support stirrup 318.

Figure 23:
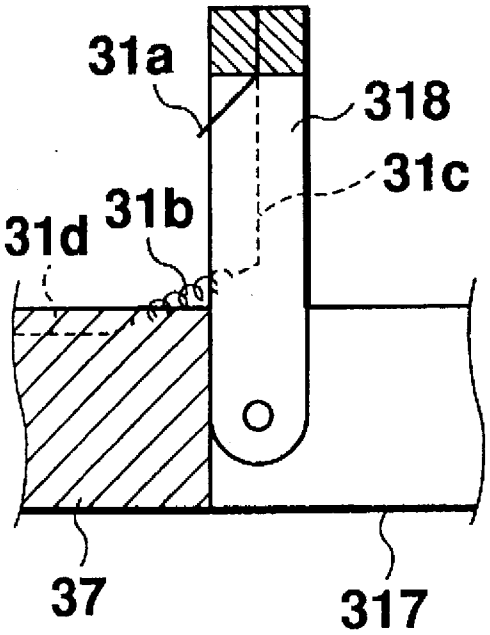

Furthermore, in the interior of the retractable access portion 37 a flexible circuit board 31*d* is arranged as shown in FIG. 23. The flexible circuit board 31*d* is electrically coupled to the contact wiring 31*a* by means of a spring 31*b* having an electrical conductivity and wiring 31*c* arranged within the support stirrup 318. The contact wiring 31*a* is so arranged as to be able to electrically couple with the contact pins 23 under the condition where the modular plug 2 is inserted in the manner stated above and where the thus inserted modular plug 2 is held by the support arms 317 and the support stirrups 318. That is, in this embodiment, the electrically coupling function is implemented by the contact wiring 31*a*, spring 31*b*, wiring 31*c* and the flexible circuit board 31*d*. Moreover, the support stirrup 318 is biased by the spring 31*b* toward its upright position, and hence the support stirrup 318 is automatically allowed to rise the instant the retractable access portion 37 is drawn out to the exterior of the PC card 1. Designated in FIG. 22 at reference numeral 320 is a groove for accommodating the spring 31*b*.

The ledge 35 interposed between the two support arms 317 serves to prevent further insertion of the modular plug to be inserted from the direction D by the contact with the broad fixed end 27. That is, the insertion regulation function is exclusively implemented by the ledge 35. Also, a retention ridge 36 is provided on the inner surfaces of the extremities of the two support arms. The retention ridge 36 implements the returning prevention function by engagement with the transition notch 28.

Figure 24:
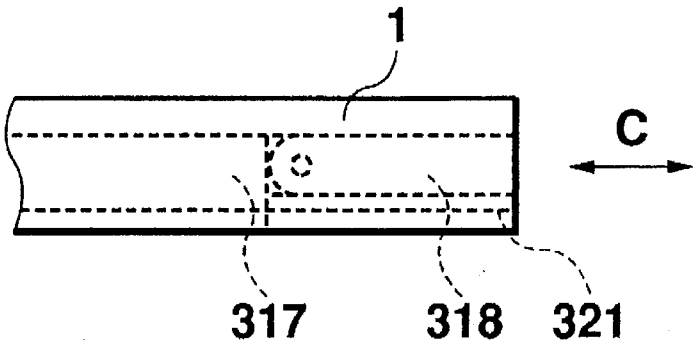
Figure 25:
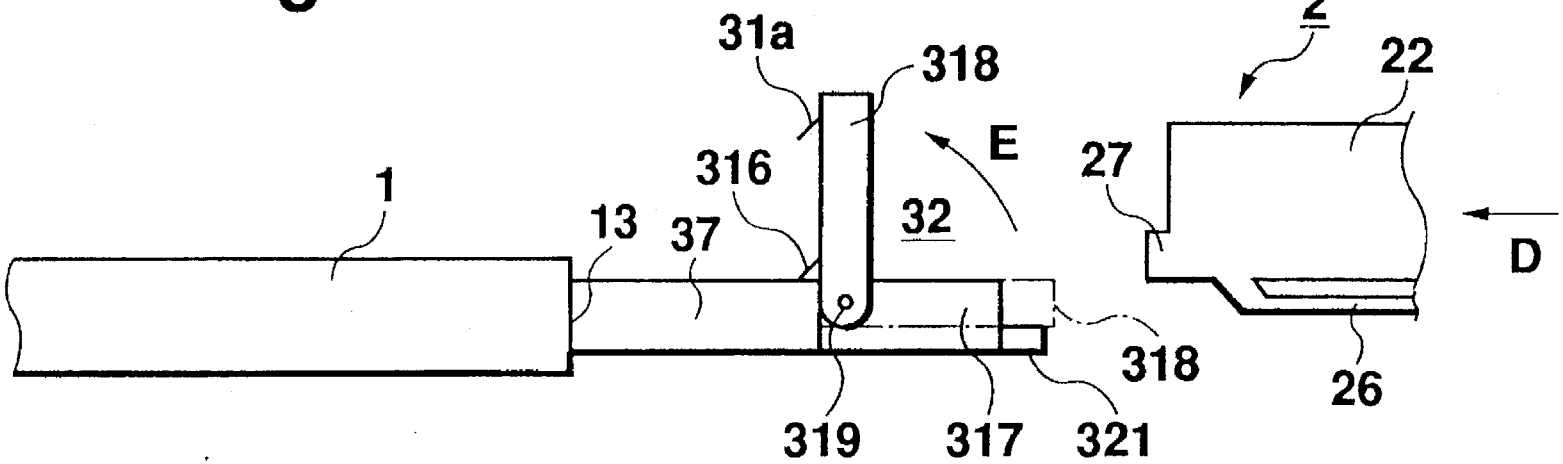
Figure 26:
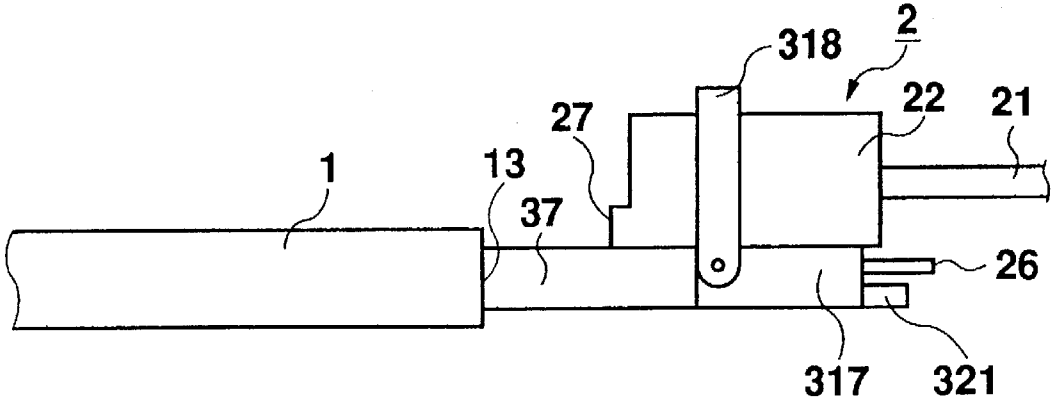
Figure 27:
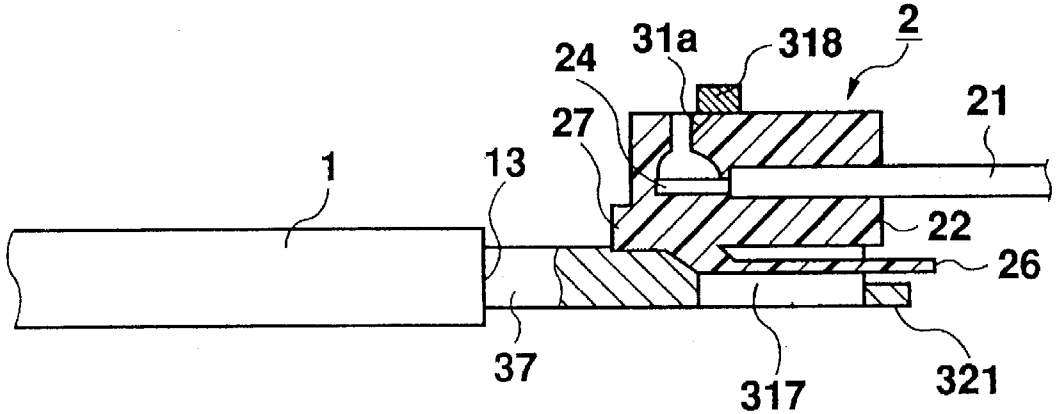

The member 321 spanning the extremities of the two support arms 317 is a stirrup supporting plate. With the retractable access portion 317 accommodated in the PC card 1 as shown in FIG. 24, the stirrup 318, is supported by the stirrup supporting plate 321. When the lock by the spring 15 is released by the operation such as pressing the stirrup supporting plate 321, a part of the retractable access portion 317, in other words, the part including the stirrup 318 is allowed to jump out to the exterior of the jack slot 13. Then, as a result of the biasing by the spring 31*b*, the stirrup 318 will rise as shown in FIG. 25. At the time the modular plug 2 is inserted into the stirrup 318 along the direction D in FIG. 25, with the narrow free end 26 downward and when the broad fixed end 27 has come into contact with the ledge 35, the contact wiring 31*a* is already in contact with the contact pin 23 and the retention ridge 36 is engaged with the transition notch 28 (see FIGS. 26 and 27). To remove the modular plug 2, it is merely required to pull the modular plug 2 in the direction opposite to the direction D while pressing the narrow free end 26 upward. The subsequent pressing of the stirrup supporting plate in the direction D would allow the open end of the jack slit 13 to push down the stirrup 318, whereby it is unnecessary for the user to push down the stirrup 318.

According to this embodiment, there can be obtained substantially the same effect as in the first embodiment. In addition, since the modular plug 2 protrudes only on one side of the retractable access portion 37, it is difficult for the modular plug 2 to conflict with the other card inserted in the slot 5 on the other side. That is, with respect to the one side of the retractable access portion 37, it is possible to realize a stabler arrangement than in the third embodiment. Moreover, this embodiment does not need the holder chamber 313, resulting in a reduced width of the retractable access portion 37 compared with the third embodiment. Also, the stirrup 318 is automatically pushed down by the open end face of the jack slot 13 when the modular plug is removed, whereby the operability is further improved.

U.S. Pat. No. 5,183,404 also discloses a jack structure having stirrups. All the plural types of stirrups disclosed in that U.S. patent are used to provide a returning prevention function and are not intended to provide the inserting direction regulating function and the electrically coupling function like the stirrup 318 in this embodiment. The stirrup shown in FIG. 21 of that U.S. patent is apparently analogous to the stirrup in this embodiment, but is actually different therefrom to a great extent. Firstly, the stirrup disclosed in FIG. 31 of that U.S. patent is rotated after the plug has been positioned in place, thereby merely fixing the plug. In contrast, the stirrup 318 according to this embodiment is a member guiding the modular plug 2 upon the insertion of the modular plug 2, and hence has been already rotated and raised prior to the insertion. Accordingly, this embodiment will allow an easier and more accurate insertion of the plug. Secondly, the stirrup disclosed in FIG. 21 of that U.S. patent is a wire-like member, not a member having some degree of mass and volume, as in this embodiment. It is therefore intrinsically impossible to realize a function such as inserting direction regulation requiring some degree of rigidity for the implementation, or a function such as electrical coupling requiring the incorporation or fixing of the wiring for the implementation. Thirdly, the structure disclosed in FIG. 21 of that U.S. patent does not effectively utilize the volume of the retractable access portion. In contrast, the stirrup 318 of this embodiment has a thickness substantially equal to that of the retractable access portion 37, thus enabling this embodiment to provide a more compact jack structure. Fourthly, all of the jack structures disclosed in that U.S. patent are such that the modular plug is inserted from the direction angled or orthogonal with respect to the retractable access portion, which differs from this embodiment in this respect.

h) Variant of Fourth Embodiment

Figure 28:
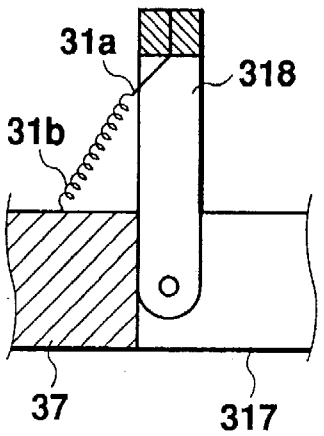
FIGS. 28 to 33 illustrate a variant of the modular jack according to the fourth embodiment of the present invention.
Figure 29:
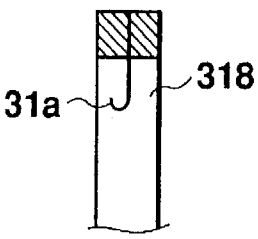

The fourth embodiment can be variously modified. For example, as shown in FIG. 28, one end of the spring 31*b* may be coupled with one end of the contact wiring 31*a*. This will eliminate the necessity of providing the wiring 31*c* within the stirrup 318, resulting in production of the stirrup 318 at low cost. It is also possible to impart a hook-like shape to the contact wiring 31*a* as shown in FIG. 29. This would prevent the contact wiring 31*a* from protruding outside the aperture or opening of the stirrup 318 at the time of unloading the plug.

Figure 30:
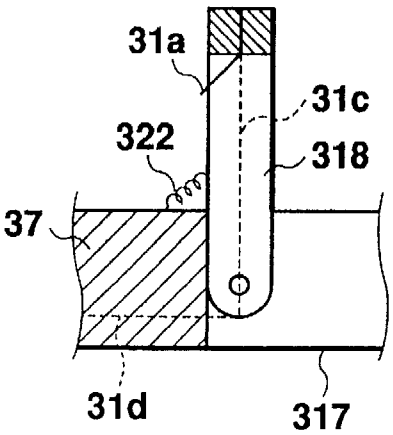
Figure 31:
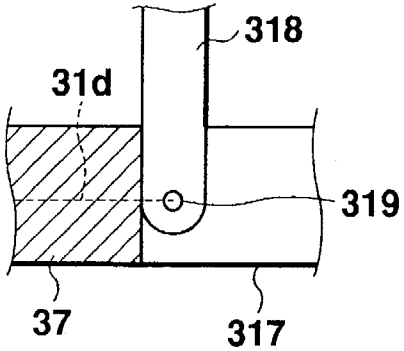
Figure 31A:
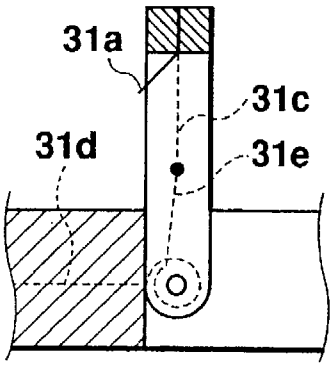
FIG. 31A being a partially enlarged sectional view showing a further example of the wirings around the support stirrup.

Also, as shown in FIG. 30, the spring 31*b* may be substituted by the spring 322 having the same function as that of the spring 31*b*. This would eliminate the necessity of taking into consideration the properties associated with the electrical conductivity when determining the materials or dimensions of the spring 322. In the case where electrical coupling has been eliminated between the spring 322 and the contact wiring 31*a*, an electrical coupling must be established between the flexible circuit board 31*d* and the wiring 31*c*. In this case, the space in the vicinity of the support arm 317 is utilized to arrange a part of the flexible circuit board 31*d*. Alternatively, as shown in FIG. 31, one end of the flexible circuit board 31*d* is electrically coupled to the pin 319 by means of the interior of the support arm 317, the pin 319 in turn being electrically coupled to the wiring 31*c*. The structure shown in FIG. 31 is advantageous over the structure shown in FIG. 30 in that the stress attendant on the rotation is not exerted on the flexible circuit board 31*d*, compared with the structure shown in FIG. 30. As shown in FIG. 31A, the interior of the support stirrup 318 may be provide with a coiled spring 31*e*. The coiled spring 31*e* is formed of an electrically conducting material to electrically connect the wiring 31*c* with the flexible circuit board 31*d*. The coiled spring is so arranged as to present a resilience biasing the support stirrup 318 toward its rising direction. The use of such a coiled spring 31*e* will enable the support stirrup 318 to automatically rise. It is to be appreciated that the wiring 31*c* and the coiled spring 31*e* may be comprised of a single wiring and that the wiring 31*c* and the coiled spring 31*e* which have been separately formed may be connected with each other by the use of solder.

Figure 32:
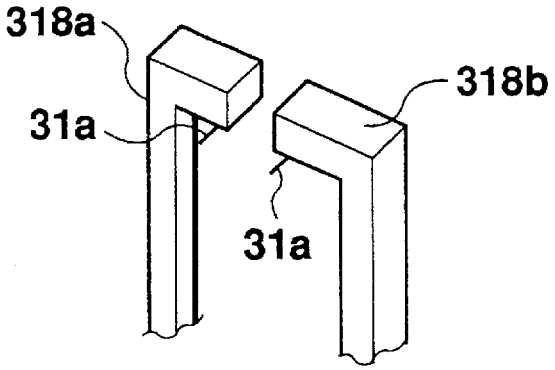
Figure 33:
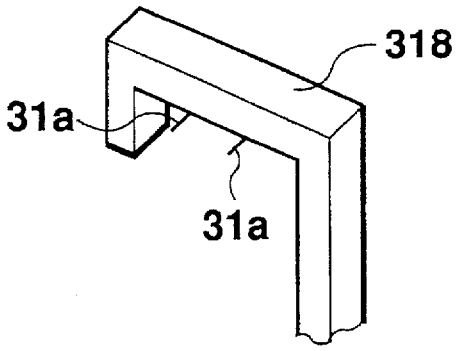

As shown in FIG. 32, the stirrup 318 may be divided into two stirrups 318*a* and 318*b* each having an L-shape. Alternatively, as shown in FIG. 33, the stirrup 318 may be L-shaped. The support arm 317 and the stirrup supporting plate 321 can be obriated. In order to obriate the support arm 317, a substitutive member is needed. In the case of obriating the stirrup supporting plate 321, the operation drawing out the retractable access portion 37 from jack slot 13 or inserting the retractable access portion 37 into the jack slit 13 is carried out by use of the stirrup 318, support arm 317 or the substitutive member. It is to be appreciated that the provision of the stirrup supporting plate will lead to a higher reliability since the stirrup 318 and the support arm 317 are not subjected to stress.

i) Fifth and Sixth Embodiments

Figure 34:
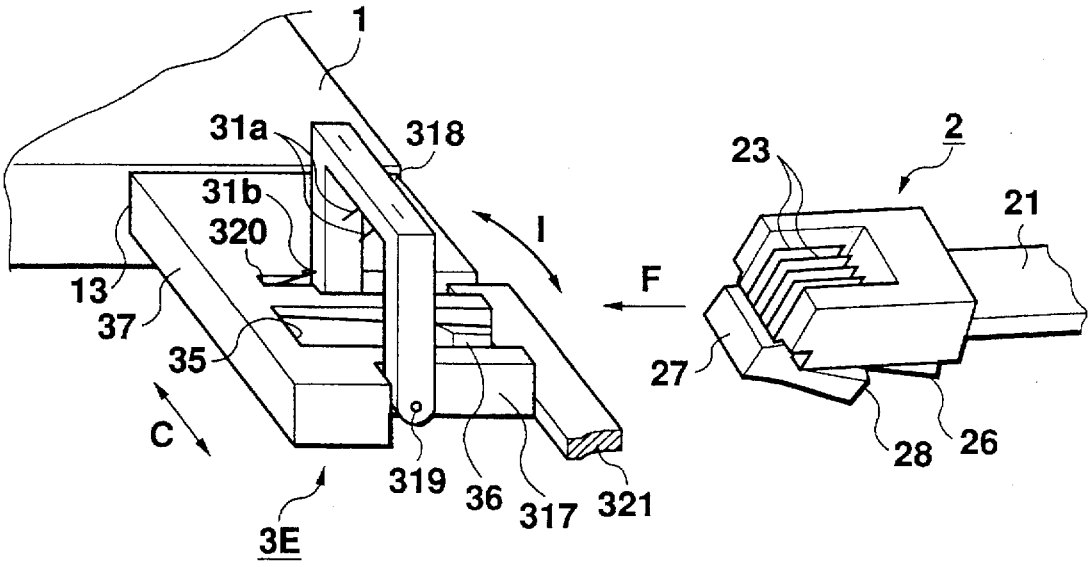
FIG. 34 is a partially cut-away perspective view depicting a modular jack viewed from diagonally above according to the fifth embodiment of the present invention.
Figure 35:
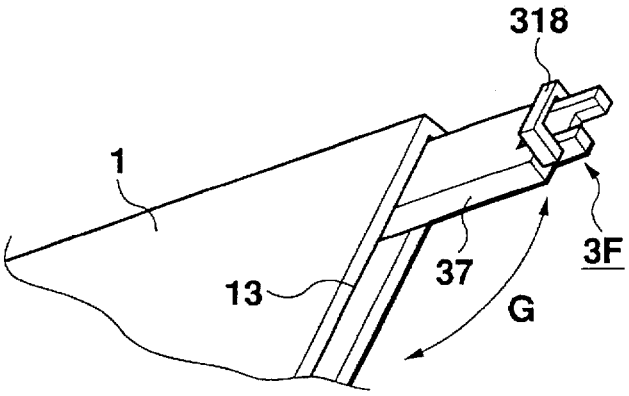
FIG. 35 is a partially cut-away perspective view depicting a modular jack viewed from diagonally above according to the sixth embodiment of the present invention.
Figure 36:
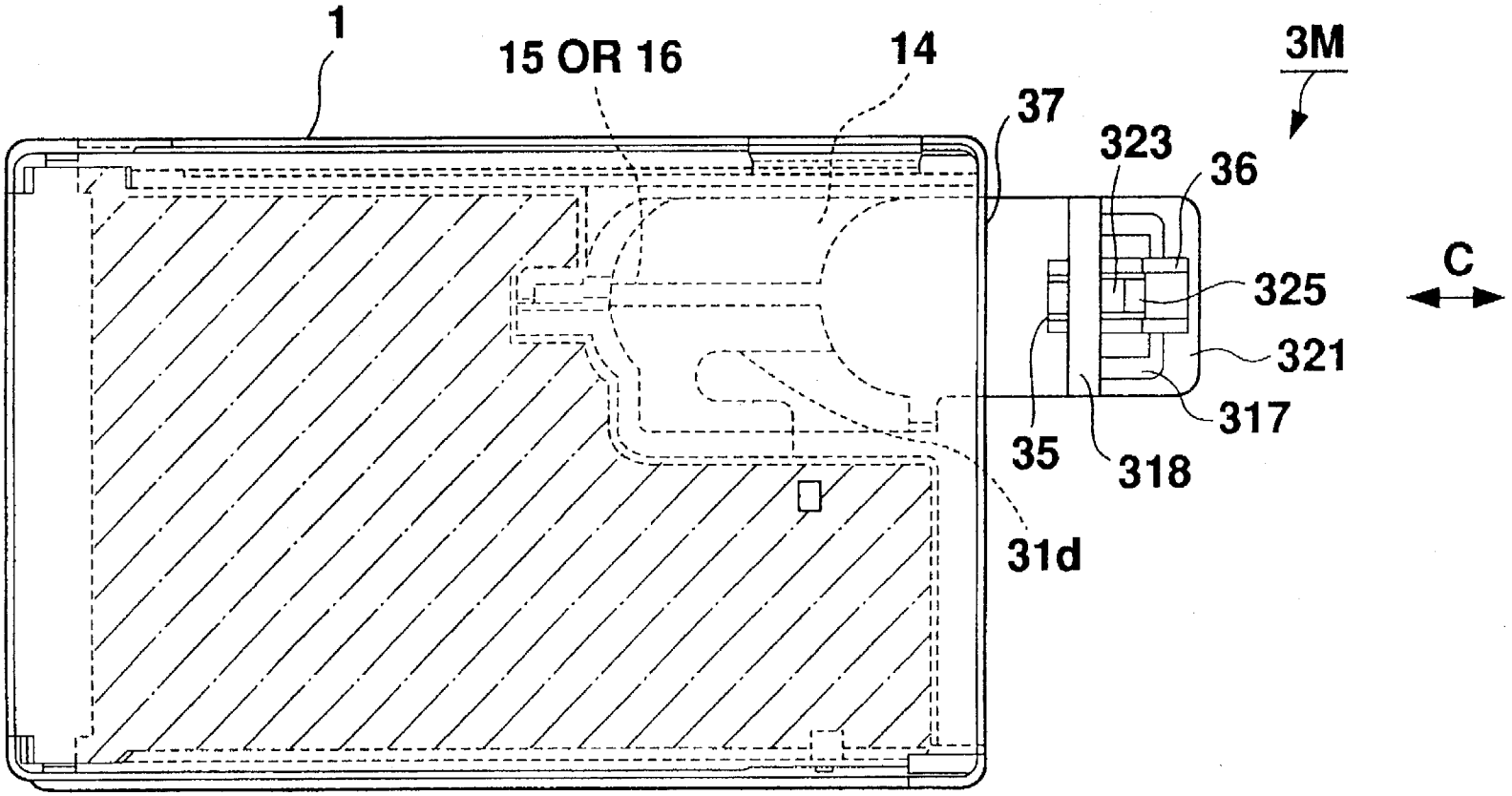
FIGS. 36 to 43 illustrate a modular jack according to the seventh embodiment of the present invention.
Figure 37:
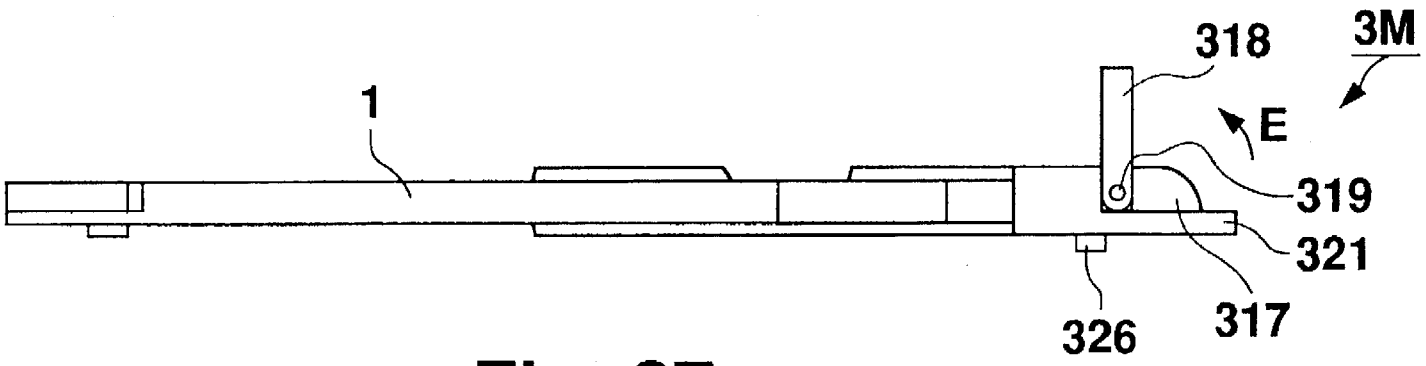
Figure 38:
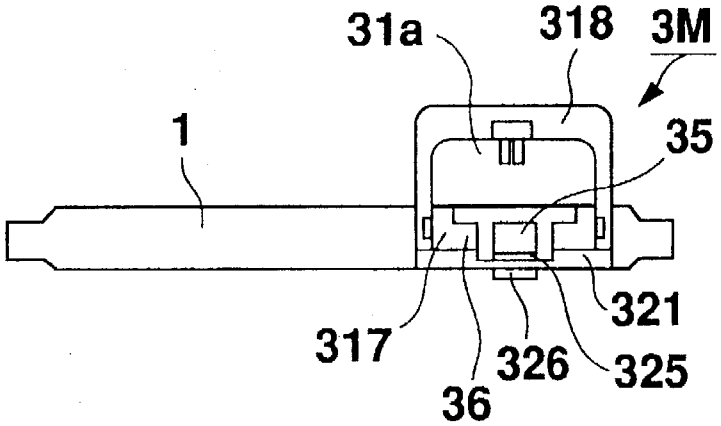
Figure 39:
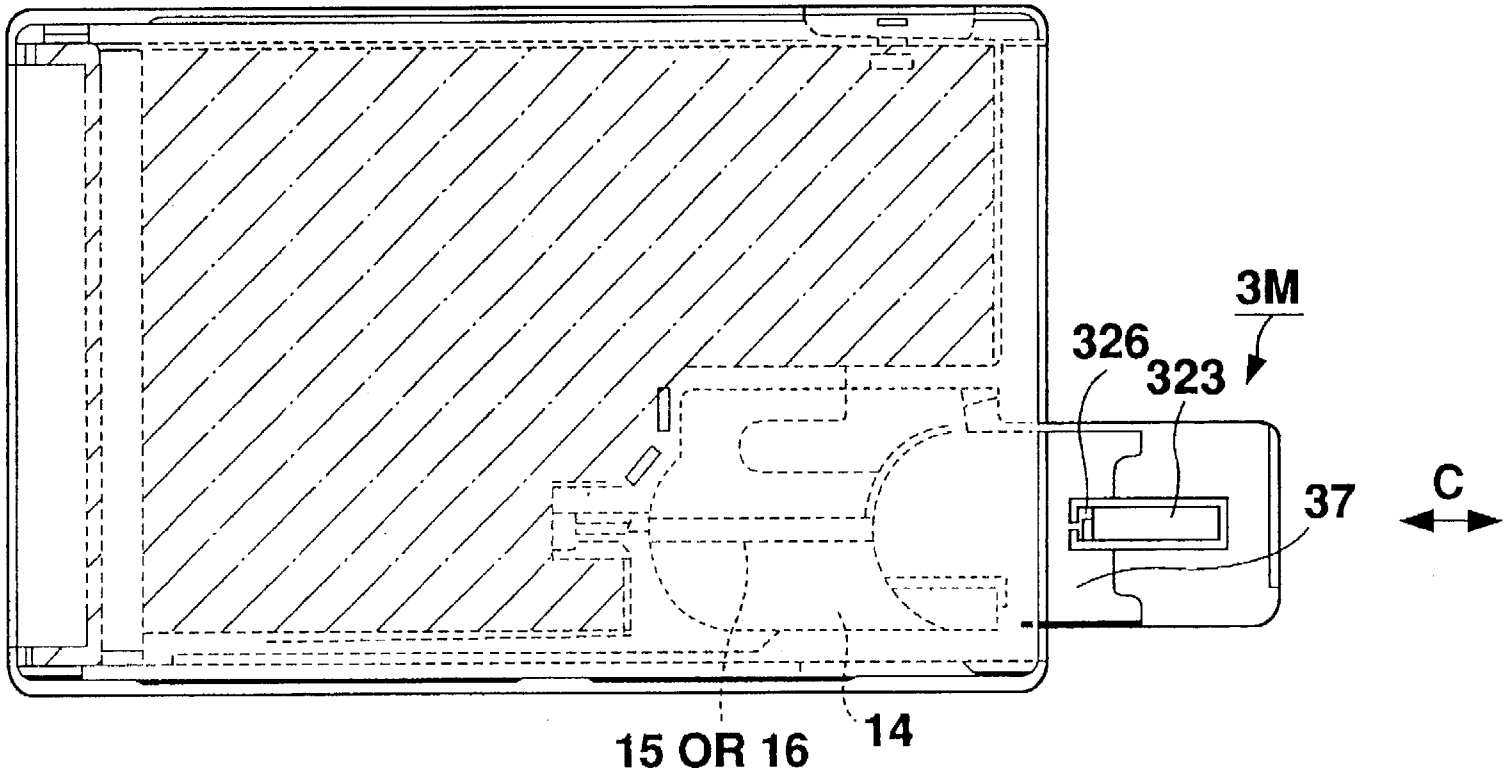
Figure 40:
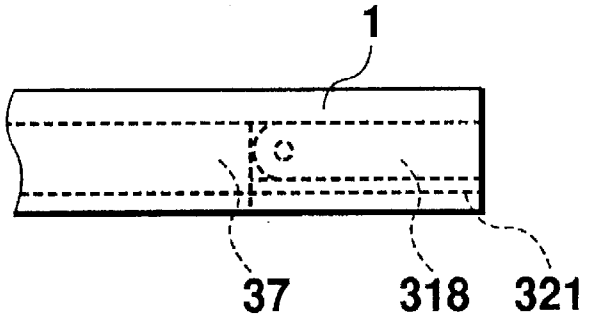
Figure 41:
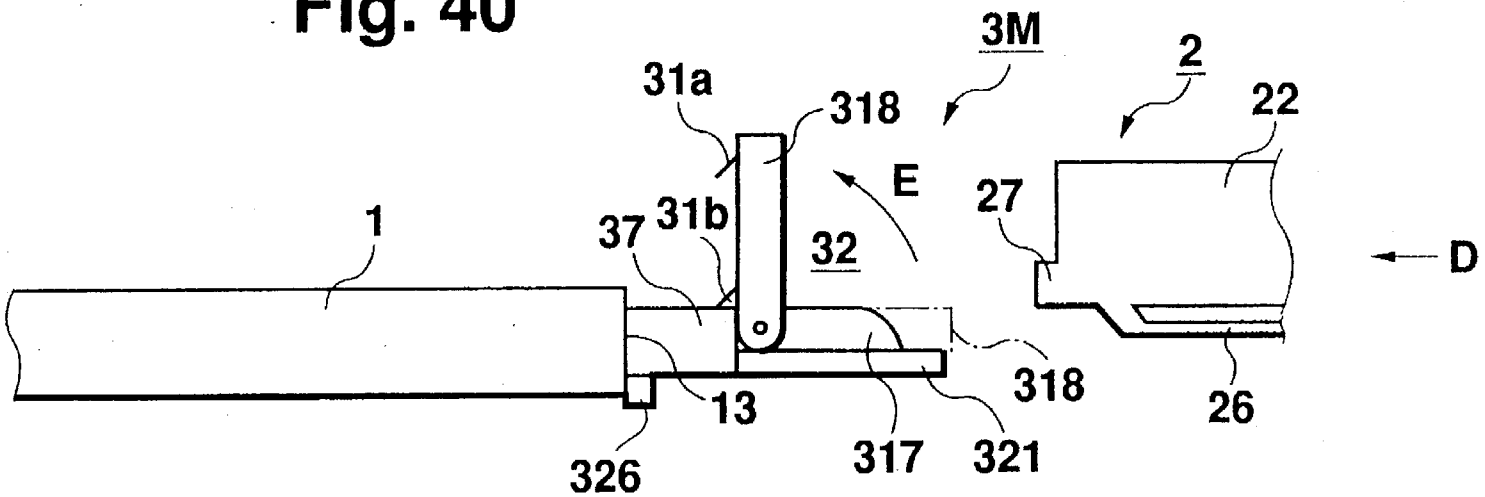
Figure 42:
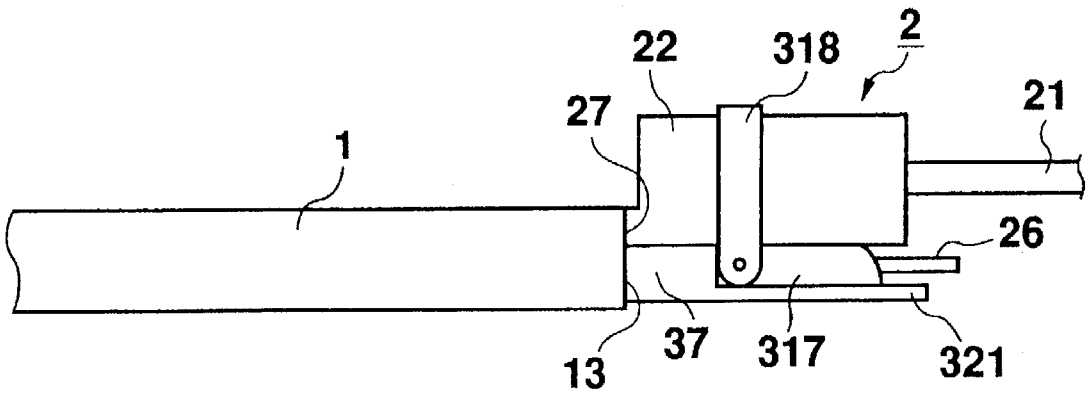
Figure 43:
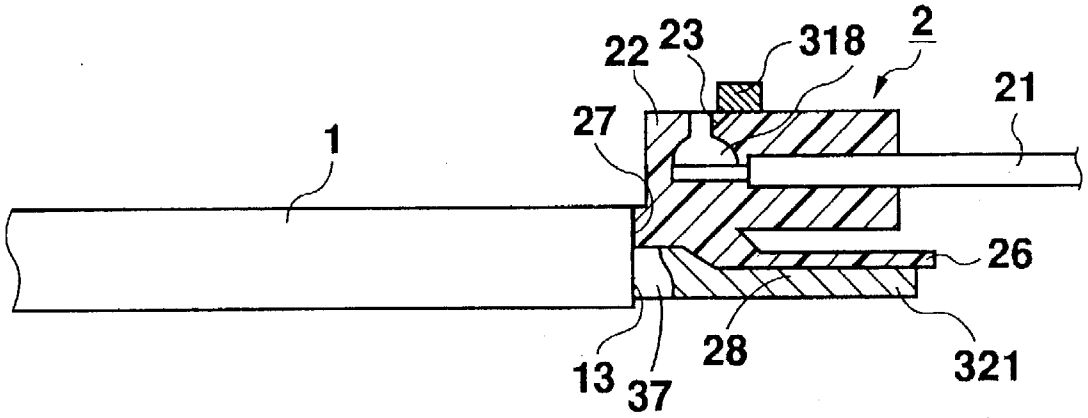

It is also possible as shown in FIG. 34 to constitute a modular jack 3E by modifying the fourth embodiment so as to allow the modular plug 2 to be inserted from the direction substantially orthogonal to the sliding direction of the retractable access portion 37. It is also possible as shown in FIG. 35 to constitute a modular jack 3f by modifying the fourth embodiment so as to allow the retractable access portion to pivot along the direction G with respect to the PC card 1. For the implementation of the structure shown in FIG. 35, use may be made of the structure shown in FIG. 13 of the U.S. Pat. No. 5,183,404.

According to these embodiments, the same effect as in the fourth embodiment can be obtained. Furthermore, the accommodation of the retractable access portion 37 into the jack slot 13 would prevent the space defined by the support arms from being seen from the exterior, contributing to a better appearance and avoiding the invasion of dust. It is to be noted that these configurations require an operation for manually leveling the stirrup 318.

j) Seventh and Eighth Embodiments

As shown in FIGS. 36 to 39, the stirrup supporting plate 321 may be U-shaped and extend directly (without the intervention of the support arms 317) from the retractable access portion. The two support arms 317 are each L-shaped and arranged on the stirrup supporting plate. This also provides a support for the modular plug 2 and ensures basic functions of the modular connector.

Also, a modular jack 3M employs a cooperation plate 32, detection pin 3235 and a hook pin 326 similar to those used in the embodiment shown in FIGS. 4 to 8. The cooperation plate 323 is provided by making use of the space surrounded by the stirrup supporting plate 321. The detection pin 325 is interposed between the two retention ridges 36 and is positioned slightly closer to the ledge 35 when viewed from the retention ridges 36. The hook pin is formed on the retractable access portion and on the back of the ledge 35. It is to be noted that the spring 324 is not shown as it is incorporated within the retractable access portion 37 and is unviewable. Thus, this embodiment ensures the same effect as in the embodiment shown in FIGS. 4 to 8.

Figure 44:
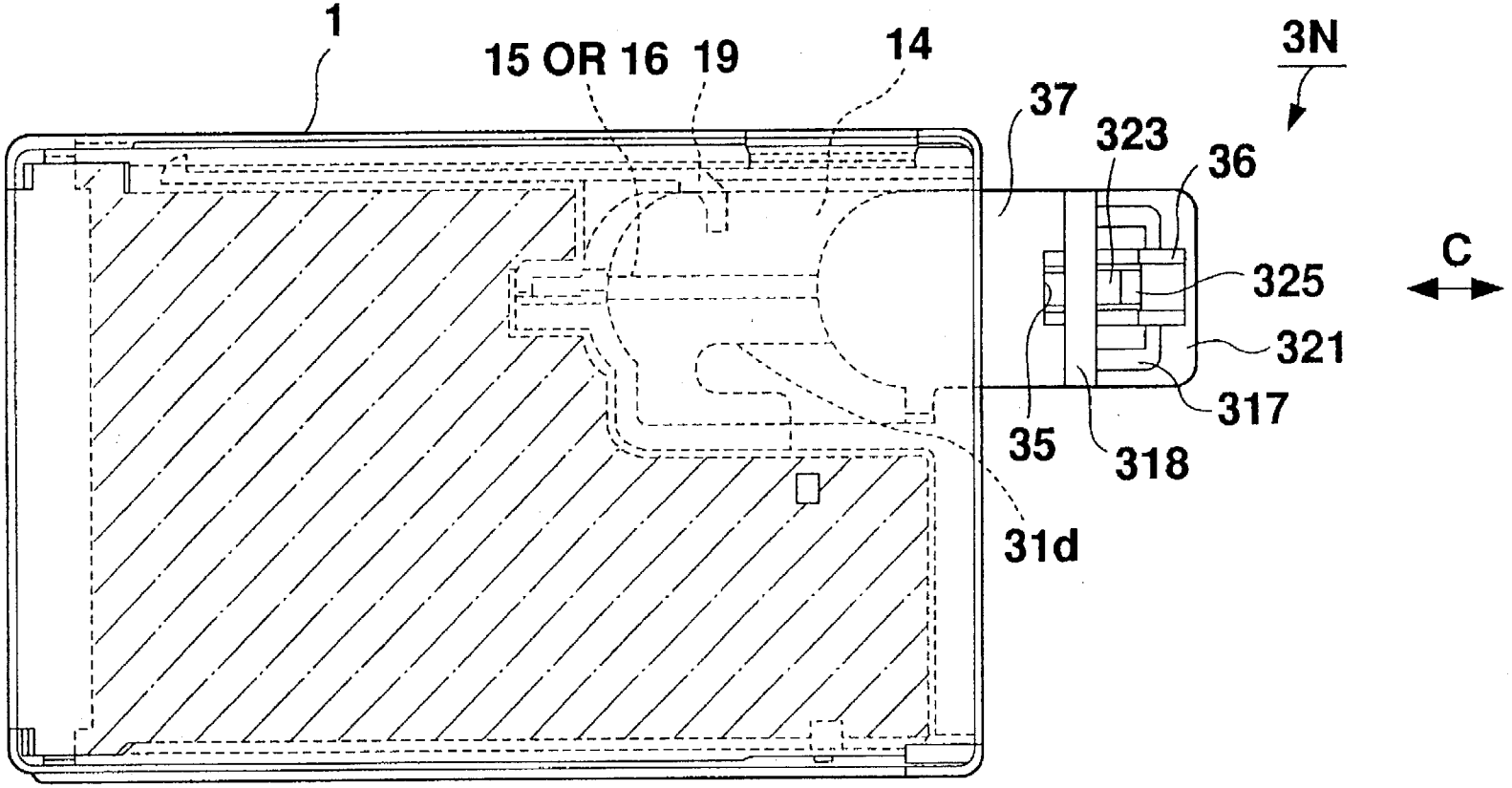
FIGS. 44 and 45 illustrate a modular jack according to the eighth embodiment of the present invention, depicting in phantom the interior of the PC card.
Figure 45:
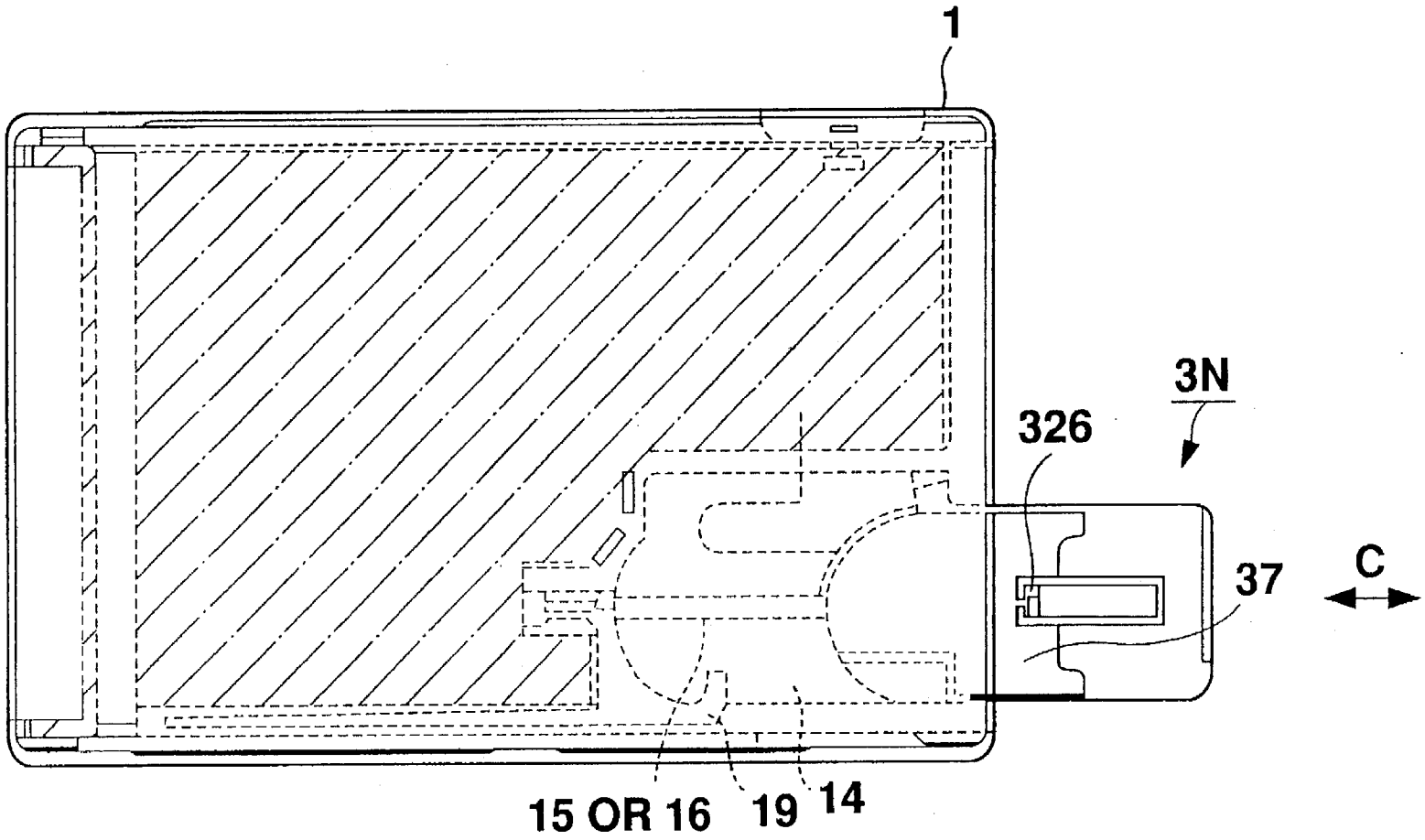

A modular jack 3N shown in FIGS. 44 and 45 comprises a combination of the embodiment depicted in FIGS. 36 to 39 and the embodiment depicted in FIGS. 12 to 16. Therefore, effects associated with both the embodiments will be obtained.

It is to be noted that designated in the diagrams by the reference numeral 31*d* is a flexible circuit board for electrically coupling the contact wiring 31*a* with the internal circuit of the PC card 1 by means of the interior of the retractable access portion 37, the flexible circuit board 31*d* being arranged within the jack chamber.

k) Supplement

Although in the above description the communication channel is assumed to be a telephone line, the present invention is applicable to the connection with the any line other than a telephone line or connection with a radio line. In the case of the application of the present invention to the connection with the radio line, the cord extending from the PC card can be connected to the radio transmitter/receiver, and the PC card can be connected to the radio line by means of the radio transmitter/receiver. Without being limited to the modular connector, the present invention is applicable to any type of connector as long as it has a structure to which the present invention is applicable by those skilled in the art. In place of the slot, any other type of structure may be used to connect the station with the PC card. It is not necessary that the thickness of the PC card be equal to 5 mm. Furthermore, there is no need to limit the type of card to a PC card or modem card, and the present invention is applicable to the types of card.

For the arrangement of the modular connector, the variant such as an upside-down arrangement is also possible. When rotatably arranging one member with respect to the other member by means of a pin or the like, the pin may be provided on the side of the one member, or reversely may be provided on the side of the other member. The pin-free side is provided with a hole or the like for accommodating the pin. The means for biasing the retractable access portion toward the exterior or the interior of the PC card is not intended to be limited to the spring, and a rubber or magnet is also available. The outward biasing as in the configuration of FIGS. 1 to 3 and the inward biasing as in the first embodiment may both be combined with the other embodiments. Alternatively, without using such biasing means, the retractable access portion need be manually drawn out. The positions of the hook and the member for receiving the hook may be reversed. The thickness of the retractable access portion may not be uniform. Also, the same modification as in FIGS. 10 and 11 may be imparted on the configuration of FIGS. 1 to 3 or the second embodiment.

What is claimed is:

1. A card having two major planes and an end face providing a thickness of said card, an upper limit of said thickness being restricted, said card including an aperture formed in said end face and having a slot-like shape, said card further comprising:

a jack composed of a base plate having a top plane and a bottom plane parallel to said major planes and an end face providing a thickness of the plate, said thickness of the base plate being smaller than a width of said aperture; said base plate being inserted into said aperture in such a manner as to be accommodated in an interior of said card and to be removed from said card, said base plate including a notch provided so as to be directed outward when viewed from said card, said notch extending through said base plate in its thickness direction, said notch having an inner surface configured to be capable of receiving a plug having a substantially rectangular parallel piped shape and having edges, the plug being connected and electrically coupled to a cord which extends into the plug, wherein said notch is configured and oriented such that upon insertion and retention of the plug in said notch, the cord extends into the plug in a direction parallel to said major planes and such that the plug is inserted in said notch in a direction which is regulated by utilizing at least a part of said inner surface.

2. A card according to claim 1, further comprising:

a biasing member for biasing said base plate inwardly of said card by way of said aperture.

3. A card according to claim 2, wherein said biasing member includes a tension spring having two ends, one of which is fixed to the interior of said card, and an other one of which is fixed to said base plate.

4. A card according to claim 2, further comprising a lock member for locking a position of said base plate with said jack exposed outside of said card.

5. A card according to claim 4, wherein said lock member has a detection member for detecting that said plug has been inserted into said jack; and a releasing member for releasing said locking in response to detection by said detection member.

6. A card according to claim 4, wherein said lock member has a releasing member for releasing said locking in response to an operation by a user.

7. A card according to claim 2, further comprising a squeezing member for squeezing said base plate outside of said card so that said jack is exposed outside of said card.

8. A card according to claim 7, wherein said squeezing member squeezes said base plate from said aperture toward the outside of said card by an external pressing force.

9. A card according to claim 8, wherein when a key provided in a slot of a station is engaged with a guide slit serving as a guide upon the insertion of said card into said slot, said squeezing member squeezes said base plate from said aperture toward the outside of said card by an external the pressing force from said key.

10. A card according to claim 8, wherein said squeezing member squeezes said base plate from said aperture toward the outside of said card, by the external pressing force applied by a pin provided on a station for electrically coupling said card with said station.

11. A card according to claim 1, wherein said plug has a claw-like member being operative along a predetermined direction upon insertion into said jack and upon drawing-out from said jack;

upon the insertion of said plug, said jack receives and retains said plug in such a manner that said predetermined direction is substantially parallel to said major planes.

12. A card according to claim 11, wherein said base plate has a falling out prevention member formed by utilizing a part of the inner surface of said notch, said falling out prevention member preventing said plug from falling out at least until said plug is removed by the operation of said claw-like member after said plug has been inserted into a predetermined position.

13. A card according to claim 1, wherein said plug has a claw-like member operated along a predetermined direction upon insertion into said jack and removal from said jack; and wherein upon insertion of said plug, said jack receives and holds said plug in such a manner that said predetermined direction is substantially orthogonal to a plane parallel to said major planes.

14. A card according to claim 13, wherein said jack has a holder rotatably mounted on the inner surface of said notch, said holder preventing said plug from being inserted beyond a predetermined position, said holder preventing said plug from falling out at least until said plug is removed by the operation of said claw-like member after the insertion of said plug into a predetermined position.

15. A card according to claim 13, wherein said base plate has a retaining member capable of retaining said claw-like member;

said plug is inserted into said jack along the direction parallel to said major planes while directing said claw-like member toward said notch.

16. A card according to claim 15, wherein said jack has a stirrup member for regulating the inserting direction and removal direction of said plug, and a biasing member for biasing said stirrup member toward said base plate.

17. A card according to claim 16, wherein said plug has a first electric coupling member for electric coupling with said jack;

said jack has a second electric coupling member for electric coupling with said first electric coupling member; and said biasing member constitutes a part of said second electric coupling member.

18. A card according to claim 1, wherein said jack includes:

a direction regulating member for guiding said plug in such a manner that upon insertion of said plug into said jack and upon removal of said plug from said jack, an inserting direction and a removal direction are regulated to predetermined directions, respectively;

an insertion stopping member for stopping motion of said plug along a predetermined inserting direction, upon insertion of said plug into said jack, at the when said plug has reached a predetermined position;

a falling-out prevention member for stopping the motion of said plug along the predetermined removal direction until said plug is removed from said jack after said plug has been inserted into a predetermined position within said jack; and an electric coupling member for electric coupling with said cord by way of said plug at least until said plug is removed from said jack after said plug has been inserted into a predetermined position within said jack.

19. A card according to claim 18, wherein at least two of said direction regulating member, insertion stopping member, falling-out prevention member, and electric coupling member are provided by said inner surface.

20. A card according to claim 19, wherein among said direction regulating member, insertion stopping member, falling-out prevention member, and electric coupling member are any member not provided by said inner surface provided by a separate member or members attached to said inner surface.

21. A jack for use in a card, the card having two major planes and an end face providing a thickness of the card, an upper limit of the thickness being restricted, the card including an aperture having a slit-like shape and formed in the end face, said jack comprising:

a base plate having a top plane and a bottom plane parallel to the major planes and an end face providing a thickness of the base plate, said thickness of said base plate being smaller than the width of the aperture; said base plate being inserted into the aperture in such a manner as to be accommodated into an interior of the card and to be removed from the card; and a notch provided on said base plate so as to be directed outward when viewed from the card, said notch extending through said base plate in its thickness direction, said notch being provided with an inner surface configured to be capable of receiving a plug having a substantially rectangular parellelpiped shape and having edges, the plug being connected and electrically coupled to a cord which extends into the plug, wherein said notch is configured and oriented such that upon insertion and retention of the plug in said notch the cord extends into the plug in a direction parallel to said major planes and such that the plug is inserted in said notch in a direction which is regulated by utilizing at least a part of said inner surface.

* * * * *